US010828744B2

(12) United States Patent
Matsushita et al.

(10) Patent No.: US 10,828,744 B2
(45) **Date of Patent: *Nov. 10, 2020**

(54) POLISHING METHOD, BRUSH-LIKE GRINDING STONE, POLISHING BRUSH, AND LINEAR MEMBER AGGREGATE

(71) Applicants: TAIMEI CHEMICALS CO., LTD., Nagano (JP); XEBEC TECHNOLOGY CO., LTD., Tokyo (JP)

(72) Inventors: Suguru Matsushita, Nagano (JP); Norihiko Sumiyoshi, Tokyo (JP)

(73) Assignees: TAIMEI CHEMICALS CO., LTD., Nagano (JP); XEBEC TECHNOLOGY CO., LTD., Tokyo (JP)

( * ) Notice: Subject to any disclaimer, the term of this patent is extended or adjusted under 35 U.S.C. 154(b) by 340 days.

This patent is subject to a terminal disclaimer.

(21) Appl. No.: 15/927,050

(22) Filed: Mar. 20, 2018

(65) Prior Publication Data

US 2018/0272495 A1 Sep. 27, 2018

Related U.S. Application Data

(62) Division of application No. 14/917,355, filed as application No. PCT/JP2014/074316 on Sep. 12, 2014, now Pat. No. 10,058,973.

(30) Foreign Application Priority Data

Sep. 13, 2013 (JP) ..... 2013-190529

(51) Int. Cl.
*B24B 29/00* (2006.01)
*B24D 13/14* (2006.01)
(Continued)

(52) U.S. Cl.
CPC ..... *B24B 29/005* (2013.01); *A46B 7/048* (2013.01); *B24D 13/145* (2013.01); *B24D 13/18* (2013.01); *A46B 2200/3086* (2013.01)

(58) Field of Classification Search
CPC ..... B24B 29/005; B24D 3/18; B24D 3/145; A46B 7/048; A46B 2200/3086
(Continued)

(56) References Cited

U.S. PATENT DOCUMENTS 1,082,922 A 12/1913 Bemis
2,311,135 A 2/1943 Steinmetz et al.
(Continued)

FOREIGN PATENT DOCUMENTS

CN 101143434 A 3/2008
CN 101959648 A 1/2011
(Continued)

OTHER PUBLICATIONS

Japan Patent Office, Office Action for Japanese Patent Application No. 2015-536655, dated Oct. 9, 2018.
(Continued)

*Primary Examiner* — George B Nguyen

(57) ABSTRACT

A brush-like grinding stone (3) in a polishing brush (1) includes a brush holder (6) and a linear member aggregate (7) detachably held in the brush holder (6). The linear member aggregate (7) includes a large number of bundles (51) of the linear members (50) obtained by hardening aggregated yarn of inorganic filaments impregnated with a resin, and a brush holder (70) holding ends of the bundles (51). A linear member holder (70) in the linear member aggregate (7) is detachably attached to each of a plurality of holding holes (68) that is open in one side in an axial line direction L. In a case where any of the linear member aggregates has a failure, such as breakage, only the failed
(Continued)

linear member aggregate needs to be replaced. Thus, it is not necessary to discard the entire brush-like grinding stone. Consequently, the polishing cost can be reduced.

5 Claims, 26 Drawing Sheets

(51) Int. Cl.
*B24D 13/18* (2006.01)
*A46B 7/04* (2006.01)

(58) Field of Classification Search
USPC ..... 451/464, 489, 466, 353, 359, 521, 510
See application file for complete search history.

(56) References Cited

U.S. PATENT DOCUMENTS

| | | | | |
|---|---|---|---|---|
| 4,217,737 | A | 8/1980 | Hasegawa | |
| 5,011,230 | A | 4/1991 | Weihrauch | |
| 5,766,060 | A | 6/1998 | Foreman et al. | |
| 6,665,902 | B1 | 12/2003 | Vegter | |
| 7,434,289 | B2 | 10/2008 | Sumiyoshi et al. | |
| 7,500,905 | B2 | 3/2009 | Iga | |
| 8,460,063 | B2 | 6/2013 | Suzuki | |
| 9,839,992 | B2 * | 12/2017 | Xue | B24D 13/10 |
| 10,011,001 | B2 * | 7/2018 | Xue | B24D 13/145 |
| 2001/0012753 | A1 | 8/2001 | Cox | |
| 2005/0153642 | A1 | 7/2005 | Matsushita et al. | |
| 2005/0260941 | A1 | 11/2005 | Palushaj | |
| 2011/0009037 | A1 | 1/2011 | Suzuki | |
| 2012/0023692 | A1 * | 2/2012 | Boucherie | A46B 3/06 15/207.2 |
| 2012/0071071 | A1 | 3/2012 | Boudreau | |
| 2016/0214228 | A1 | 7/2016 | Matsushita et al. | |

FOREIGN PATENT DOCUMENTS

| | | | |
|---|---|---|---|
| CN | 102069446 | A | 5/2011 |
| CN | 102131619 | A | 7/2011 |
| CN | 102310359 | A | 1/2012 |
| CN | 103203682 | A | 7/2013 |
| DE | 2727292 | A1 | 1/1979 |
| GB | 2394409 | A | 4/2004 |
| JP | S49-45555 | | 12/1974 |
| JP | S50-15364 | | 2/1975 |
| JP | S59-89113 | U | 6/1984 |
| JP | S61-222405 | A | 10/1986 |
| JP | S62-85360 | U | 5/1987 |
| JP | 2002-219656 | A | 8/2002 |
| JP | 2002-254277 | A | 9/2002 |
| JP | 3090920 | U | 1/2003 |
| JP | 2003-136413 | A | 5/2003 |
| JP | 2005-262360 | A | 9/2005 |
| JP | 2006-116687 | A | 5/2006 |
| JP | 2009-072543 | A | 4/2009 |
| JP | 2009-202274 | A | 9/2009 |
| JP | 2009-214185 | A | 9/2009 |
| JP | 2010-274332 | A | 12/2010 |
| JP | 2012-011523 | A | 1/2012 |
| JP | 2012-218080 | A | 11/2012 |
| JP | 2013-141731 | A | 7/2013 |
| WO | 2004/009293 | A1 | 1/2004 |

OTHER PUBLICATIONS

International Search Report for PCT/JP2014/074316, dated Dec. 9, 2014.
Written Opinion of the International Searching Authority for PCT/JP2014/074316, dated Dec. 9, 2014.
State Intellectual Property Office of the People's Republic of China, Office Action for Chinese patent application No. 201480047868.5, dated Oct. 8, 2016.
State Intellectual Property Office of the People's Republic of China, Office Action for Chinese patent application No. 201480047868.5, dated May 25, 2017.
State Intellectual Property Office of the People's Republic of China, Office Action for Chinese patent application No. 201480047868.5, dated Dec. 14, 2017.
State Intellectual Property Office of the People's Republic of China, Supplemental Search report for Chinese patent application No. 201480047868.5, dated Dec. 6, 2017.
Non-Final Office Action for U.S. Appl. No. 14/917,355 (which is a parent application of the present application), dated Dec. 28, 2017.
Japan Patent Office, Office Action for Japanese patent application No. 2015-536655, dated May 8, 2018.

* cited by examiner

POLISHING METHOD, BRUSH-LIKE GRINDING STONE, POLISHING BRUSH, AND LINEAR MEMBER AGGREGATE

This application is a divisional of patent application Ser. No. 14/917,355 filed on Mar. 8, 2016, which is National Stage Application of International Application No. PCT/JP2014/074316, filed on Sep. 12, 2014, the disclosure of which is incorporated herein by reference in its entirety. The International Application No. PCT/JP2014/074316 is entitled to and claims benefit of Japanese Patent Application No. 2013-190529, filed on Sep. 13, 2013, the disclosures of which are incorporated herein by reference in their entireties.

FIELD

The present invention relates to a brush-like grinding stone, a polishing brush including the brush-like grinding stone, and a linear member aggregate obtained by bundling the linear members. Note that, in the following description, linear members exert, at the tips thereof, an effect similar to grinding while polishing a workpiece. In addition, the linear members exert, at the tips thereof, the effect similar to grinding while deburring the workpiece. Thus, the following description does not discriminate between "polishing" and "grinding".

BACKGROUND

Brush-like grinding stones including linear members each formed by hardening aggregated yarn of inorganic filaments, such as aluminum filaments, by a resin binder, and brush-like grinding stones including linear members of brass, nylon, or other material have been introduced. In such a brush-like grinding stone, an end of each bundle of the linear members is fixed in each of holes provided in a brush holder with adhesive. The brush-like grinding stone is held in a brush case in a polishing brush to be used for polishing (Patent Literature 1).

CITATION LIST

Patent Literature

Patent Literature 1: WO 2004/009293

SUMMARY

Technical Problem

In order to effectively polish a wide area of a workpiece with the brush-like grinding stone and the polishing brush disclosed in Patent Literature 1, a structure is required to include a brush holder with a large diameter and a large number of bundles of the linear members provided to an entire wide area on the brush holder.

The brush-like grinding stone and the polishing brush disclosed in Patent Literature 1 use aggregated yarn of inorganic filaments, such as aluminum filaments, as the linear member, and thus the bundles different from linear members of nylon can be partially broken. If the bundles are broken, the whole brush-like grinding stone needs to be replaced and discarded. However, the brush-like grinding stone with a large diameter includes a large number of bundles of the linear members, and the brush holder is expensive because of the large diameter. Therefore, there is a problem that the disposal cost is increased by replacing the brush-like grinding stone every time when the bundles are partially broken.

Another problem in the cost and the resource saving is that the whole brush-like grinding stone needs to be replaced and discarded when the linear members fixed to the brush holder with adhesive are worn.

Furthermore, when the type of the linear members attached to the brush holder and the number of the bundles of the linear members are demanded to be changed in accordance with the kind of the workpiece to be polished or other conditions, the brush-like grinding stone and the polishing brush disclosed in Patent Literature 1 cannot change the number of the bundles of the linear members because the bundles of the linear members are fixed to the brush holder with adhesive. For this reason, a variety of brush-like grinding stones corresponding to the kinds of target workpieces or other conditions need to be prepared, and lead to the increase in the costs because the brush-like grinding stones with a large diameter are expensive.

An object of the present invention in view of the problems discussed above is to provide a polishing method, a brush-like grinding stone, a polishing brush, and a linear member aggregate that are capable of reducing the polishing cost even in a case where polishing uses a large number of bundles of linear members attached to a brush holder.

Solution to Problem

To solve the problems, the present invention relates to a polishing method using a brush-like grinding stone including a bundle of linear members and a brush holder that holds the bundles, the polishing method including: preparing the brush-like grinding stone by fixing an end of the bundle to a linear member holder to prepare a linear member aggregate and detachably attaching the linear member holder to each of a plurality of holding holes on the brush holder that is open in one side in an axial line direction; and performing polishing after at least one of attaching and removing the linear member aggregate to and from the brush holder when the linear member aggregate held on the brush holder needs to be reduced, added, or replaced before performing the polishing.

In the present invention, the linear member aggregate obtained by fixing the bundle of the linear member to the linear member holder is detachably attached to the holding holes in the brush holder. With this configuration, the linear member aggregates held on the brush holder can be easily reduced, added, and replaced as needed. Thus, in a single brush-like grinding stone, the number of the linear member aggregates can be changed in accordance with the kind of the workpiece to be polished or other conditions even though the bundles of the linear members are provided to an entire wide area on the brush holder for effectively polishing a wide area on the workpiece. In addition, in a case where any of the linear member aggregates has a failure, such as breakage, only the failed linear member aggregate needs to be replaced. Thus, it is not necessary to discard the entire brush-like grinding stone. Consequently, the polishing cost can be reduced.

A brush-like grinding stone according to the present invention includes: at least one linear member aggregate including a bundle of a large number of linear members and a linear member holder to which an end of the bundle is fixed; and a brush holder having a plurality of holding holes that are open in one side in an axial line direction, the linear member holders being detachably attached to the respective holding holes.

In the present invention, the linear member aggregate obtained by fixing the bundle of the linear member to the linear member holder is detachably attached to the holding holes in the brush holder. With this configuration, the linear member aggregate held on the brush holder can be easily reduced, added, and replaced as needed. Thus, in a single brush-like grinding stone, the number of the linear member aggregates can be changed in accordance with the kind of the workpiece to be polished or other conditions even though the bundles of the linear members are provided to an entire wide area on the brush holder for effectively polishing a wide area on the workpiece. In addition, in a case where any of the linear member aggregates has a failure, such as breakage, only the failed linear member aggregate needs to be replaced. Thus, it is not necessary to discard the entire brush-like grinding stone. Consequently, the polishing cost can be reduced.

In the present invention, it is preferable that the brush holder include a disk-like bottom plate and a cylinder protruding from an outer circumference of the bottom plate toward the one side in the axial line direction, the cylinder having a front end surface on which the holding holes are formed. With this configuration, the brush holder can be reduced in weight even if the brush holder is radially enlarged. In addition, the cylinder protrudes in the axial line direction from the outer peripheral of the bottom plate, serving as a weight. Thus, the brush holder can rotate stably. Furthermore, because the holding holes are provided to the front end surface of the cylinder, the holding holes having a sufficient depth can be formed.

In the present invention, it is preferable that a distance d and a radius r satisfy the following conditional expression:

$$r<0.111d$$

where d is a radial distance from a center axis of the brush holder to a position of the linear member holder attached to the brush holder, and r is a radius of the bundle. With this configuration, when the brush holder is rotated about the center axis to perform polishing, the difference between the peripheral speed of the linear members in the bundles close to the radial center of the brush holder and the peripheral speed of the linear members in the bundles close to the radially outer circumference of the brush holder can be less than 20%. As a result, proper polishing can be performed.

It is preferable that the distance d and the radius r satisfy the following conditional expression:

$$r<0.0526d$$

With this configuration, when the brush holder is rotated about the center axis to perform polishing, the difference between the peripheral speed of the linear members in the bundles close to the radial center of the brush holder and the peripheral speed of the linear members in the bundles close to the radially outer circumference of the brush holder can be less than 10%. As a result, proper polishing can be performed.

In the present invention, the linear member holder may include a holder part having a non-circular shape when viewed in the axial line direction, and the brush holder may include at least one fitting part into which the holder part fits when the linear member holder is inserted in the holding holes. This configuration can prevent the linear member holder inserted in the holding hole from rotating in the holding hole, thereby preventing the behavior of the linear member aggregate fixed to the brush holder from being unstable in polishing.

In the present invention, it is preferable that the linear member holder be detachably attached to the holding holes in the brush holder with a threaded fixing mechanism.

For example, the brush holder may be provided with a fixing hole passing through from an outer circumferential surface of the brush holder to the holding holes, and the threaded fixing mechanism may include a female thread and a set screw, the female thread being formed in an inner circumferential surface of the fixing hole, the set screw being configured to contact the linear member holder by being set to the female thread in the fixing hole. With this configuration, the linear member holders can be fixed to the brush holder with a simple structure.

In this case, a tip end of the set screw may be positioned in a set-screw positioning recess provided to an outer circumferential surface of the linear member holder. With this configuration, the contact position of the set screw can be regulated with the recess provided to the linear member holder. In addition, the rotation of the linear member holder in the holding hole can be prevented or suppressed.

For example, the following structure is optional in that the linear member holder is provided with a first fixing hole passing through the linear member holder in a direction orthogonal to the axial line direction in a part opposite to a side to which the linear members extend, the brush holder is provided with a second fixing hole passing through from an outer circumferential surface of the brush holder to the holding holes, and the threaded fixing mechanism includes a female thread and a set screw, the female thread being formed in an inner circumferential surface of the first fixing hole, the set screw being configured to contact an inner wall of the holding holes opposite to the second fixing hole by being set to the female thread in the first fixing hole.

In this case, the second fixing hole may be a groove extending in the axial line direction formed by cutting out the one side of the brush holder in the axial line direction. With this configuration, the linear member aggregate can be attached and detached in a state that the set screw is fit to the linear member holder. For example, when the linear member aggregate is attached to the linear member holder, the set screw is screwed in the first fixing hole and an end of the set screw is protruded toward the outer circumferential side (toward the second fixing hole). The protruded end is inserted from the one side in the axial line direction to the second fixing hole formed as a groove, so that the linear member holder is inserted in the holding hole. Subsequently, the set screw is screwed to fix the linear member aggregate to the brush holder. With this configuration, the linear member holder can be inserted in the holding hole in a state that the orientation of the linear member aggregate is adjusted, and thus attaching the linear member aggregate is easy. For example, when the linear member aggregate is removed from the linear member holder, the set screw is loosened and the one end of the set screw is protruded toward the second fixing hole. By moving the set screw to the one side in the axial line direction in this state, the linear member aggregate can be removed without fully unscrewing the set screw from the first fixing hole in the linear member holder. Thus, removing the linear member aggregate is easy.

The following structure is optional in that the linear member holder is provided with a first fixing hole passing through the linear member holder in a direction orthogonal to the axial line direction in a part opposite to a side to which the linear members extend, the brush holder is provided with a second fixing hole passing through from the outer circumferential surface of the brush holder to the holding holes, and a third fixing hole open on an inner wall of the holding holes opposite to the second fixing hole at a position in communication with the first fixing hole, and the threaded fixing mechanism includes a female thread and a set screw, the female thread being formed in an inner circumferential surface of the third fixing hole, the set screw being configured to be set in the female thread through the first fixing hole.

In this case, the second fixing hole may be a groove extending in the axial line direction formed by cutting out the one side of the brush holder in the axial line direction. With this configuration, the linear member aggregate can be attached and detached in a state that the set screw is fit to the linear member holder. For example, when the linear member aggregate is attached to the brush holder, the set screw is attached to the first fixing hole and an end of the set screw is protruded toward the outer circumferential side (toward the second fixing hole). The protruded end is inserted from the one side in the axial line direction to the second fixing hole formed as a groove, so that the linear member holder is inserted in the holding hole. Subsequently, the set screw is set to the female thread of the third fixing hole to fix the linear member aggregate to the brush holder. With this configuration, the linear member holder can be inserted in the holding hole in a state that the orientation of the linear member aggregate is adjusted, and thus attaching the linear member aggregate is easy. For example, when the linear member aggregate is removed from the linear member holder, the set screw set to the female thread of the third fixing hole is loosen and the one end of the set screw is protruded toward the second fixing hole. By moving the set screw to the one side in the axial line direction in this state, the linear member aggregate can be removed without fully unscrewing the set screw from the first fixing hole in the linear member holder. Thus, removing the linear member aggregate is easy.

The following structure is optional in that the brush holder is provided with a first is provided with a first fixing hole that is open in a surface on the other side in the axial line direction, the brush holder is provided with a second fixing hole in communication with the holding holes at a position overlapping the linear member holder on the other side, and the threaded fixing mechanism includes a female thread and a set screw, the female thread being formed in the first fixing hole, the set screw being configured to be set in the female thread through the second fixing hole.

The following structure is optional in that the threaded fixing mechanism includes a female thread and a male thread, the female thread being formed in an inner circumferential surface of the holding holes, the male thread being formed in an outer circumferential surface of the linear member holder.

In the present invention, the following structure is optional in that the linear member holder is detachably attached to the holding holes in the brush holder with a magnetic fixing mechanism. With this configuration, replacement of the linear member aggregate is easy.

In this case, it is preferable that the linear member holder include an iron-based metallic part, and the brush holder hold a magnet magnetically attracting the linear member holder. With this configuration, for example, disposal cost can be reduced as compared to a case where the magnets are provided to the linear member holders (linear member aggregates).

In the present invention, it is preferable that the brush holder be provided with a through hole in communication with the holding holes at a position overlapping the linear member holder on the other side opposite to the one side in the axial line direction when viewed in the axial line direction. With this configuration, the linear member holder can be pushed out from the holding hole with a jig inserted in the through hole, when the linear member aggregate is replaced.

In the present invention, the following structure is optional in that the brush holder is provided with a through hole in communication with the holding holes at a position overlapping the linear member holder on the other side opposite to the one side in the axial line direction when viewed in the axial line direction, the linear member holder includes a supported part directed to a side to which the linear members extend in the axial line direction, the holding holes have an inner circumferential surface to which a supporting part for supporting the supported part is provided on the side to which the linear members extend, and the brush holder is provided with a fastener detachably fixed thereto, the fastener pressing the linear member holder fit in the holding holes through the through hole from the opposite side to the side to which the linear members extend toward the side to which the linear members extend.

In the present invention, the linear members may be obtained by hardening aggregated yarn of inorganic filaments impregnated with a resin.

For example, the brush-like grinding stone to which the present invention is applied is used for a polishing brush including a brush case configured to hold the brush holder so as to be capable of adjusting a position of the brush-like grinding stone in the axial line direction. With this structure, the position of the linear members in the axial line direction is adjustable, and thus the contact pressure between the linear members and the workpiece is adjustable.

In this case, it is preferable that the brush case may include a spindle extending inside the brush case in the axial line direction and a peripheral wall provided with a groove-like guide hole extending in the axial line direction, the brush holder may be provided with a spindle hole into which the spindle is fit and a screw hole reaching the spindle hole from an outer circumferential surface of the brush holder, and the screw hole may be configured to set a screw therein so that a tip of a shaft of the screw is in contact with an outer circumferential surface of the spindle. With this configuration, a screw can be fastened and loosened with a tool inserted from a guide hole or other means, and thus the position of the linear members protruded from the peripheral wall is easily adjusted. Therefore, the contact pressure between the linear members and the workpiece is adjustable.

In the present invention, it is preferable that the spindle be provided with a flow path passing through the spindle in the axial line direction. With this configuration, the cutting agent can be discharged from the flow path, and thus cutting dust is efficiently flown out. As a result, clogging with cutting dust is hard to occur on the tips of the linear members, and therefore the polishing performance can be kept from decreasing.

It is preferable that the spindle be provided with a stopper regulating a displacement of the linear members to a radial inward direction. With this structure, the displacement of the linear members to the radial inward direction is regulated, and thus the contact pressure between the linear members and the workpiece is kept in an appropriate level.

A linear member aggregate according to the present invention includes a large number of linear members obtained by hardening aggregated yarn of inorganic filaments impregnated with a resin; and a linear member holder to which an end of a bundle of the linear members is fixed, wherein the linear member holder includes a holder part having a non-circular shape when viewed in an axial line direction of the bundle. With this configuration, by providing the holding hole with a fitting part configured to fit the holder part, the linear member holder inserted in the holding hole is prevented from rotating in the holding hole. Consequently, the behavior of the linear member aggregate fixed to the brush holder is prevented from being unstable in polishing.

A linear member aggregate includes a large number of linear members obtained by hardening aggregated yarn of inorganic filaments impregnated with a resin; and a linear member holder to which an end of a bundle of the linear members is fixed, wherein the linear member holder is provided with a fixing hole passing through the linear member holder in a direction orthogonal to an axial line direction in a part opposite to a side to which the linear members extend in the axial line direction. With this configuration, the linear member aggregate can be detachably attached to the brush holder with the fixing hole.

In this case, the following structure is optional in that the fixing hole has a female thread on an inner circumferential surface thereof.

A linear member aggregate according to another aspect of the present invention includes: a large number of linear members obtained by hardening aggregated yarn of inorganic filaments impregnated with a resin; and a linear member holder to which an end of a bundle of the linear members is fixed, wherein the linear member holder is provided with a fixing hole open in a surface opposite to a side to which the linear members extend in an axial line direction, the fixing hole having a female thread on an inner circumferential surface thereof. With this configuration, the linear member aggregate can be detachably attached to the brush holder with the fixing hole.

A linear member aggregate according to yet another aspect of the present invention includes: a large number of linear members obtained by hardening aggregated yarn of inorganic filaments impregnated with a resin; and a linear member holder to which an end of a bundle of the linear members is fixed, wherein the linear member holder includes an iron-based metallic part. With this configuration, the linear member aggregate can be detachably attached to the brush holder with a magnet.

A linear member aggregate according to yet another aspect of the present invention includes: a large number of linear members obtained by hardening aggregated yarn of inorganic filaments impregnated with a resin; and a linear member holder to which an end of a bundle of the linear members is fixed, wherein the linear member holder has an outer circumferential surface including a part in which an outer diameter of a side in an axial line direction opposite to a side to which the linear members extend is larger than the outer diameter of the side to which the linear members extend. With this configuration, the linear member aggregate can be detachably attached to the brush holder with the part having the larger outer diameter.

A linear member aggregate according to yet another aspect of the present invention includes: a large number of linear members obtained by hardening aggregated yarn of inorganic filaments impregnated with a resin; and a linear member holder to which an end of a bundle of the linear members is fixed, wherein the linear member holder has a male thread on an outer circumferential surface thereof. With this configuration, the linear member aggregate can be detachably attached to the brush holder with the male thread.

DESCRIPTION OF EMBODIMENTS

Embodiments of the present invention are described below with reference to the drawings. Note that, in the following description, one side L1 is the side to which a linear member 50 extends in an axial line L of a polishing brush 1 and a brush-like grinding stone 3, whereas the other side L2 is the side opposite to the side to which the linear member 50 extends.

Embodiment 1

(Entire Structure)

Figure 1:
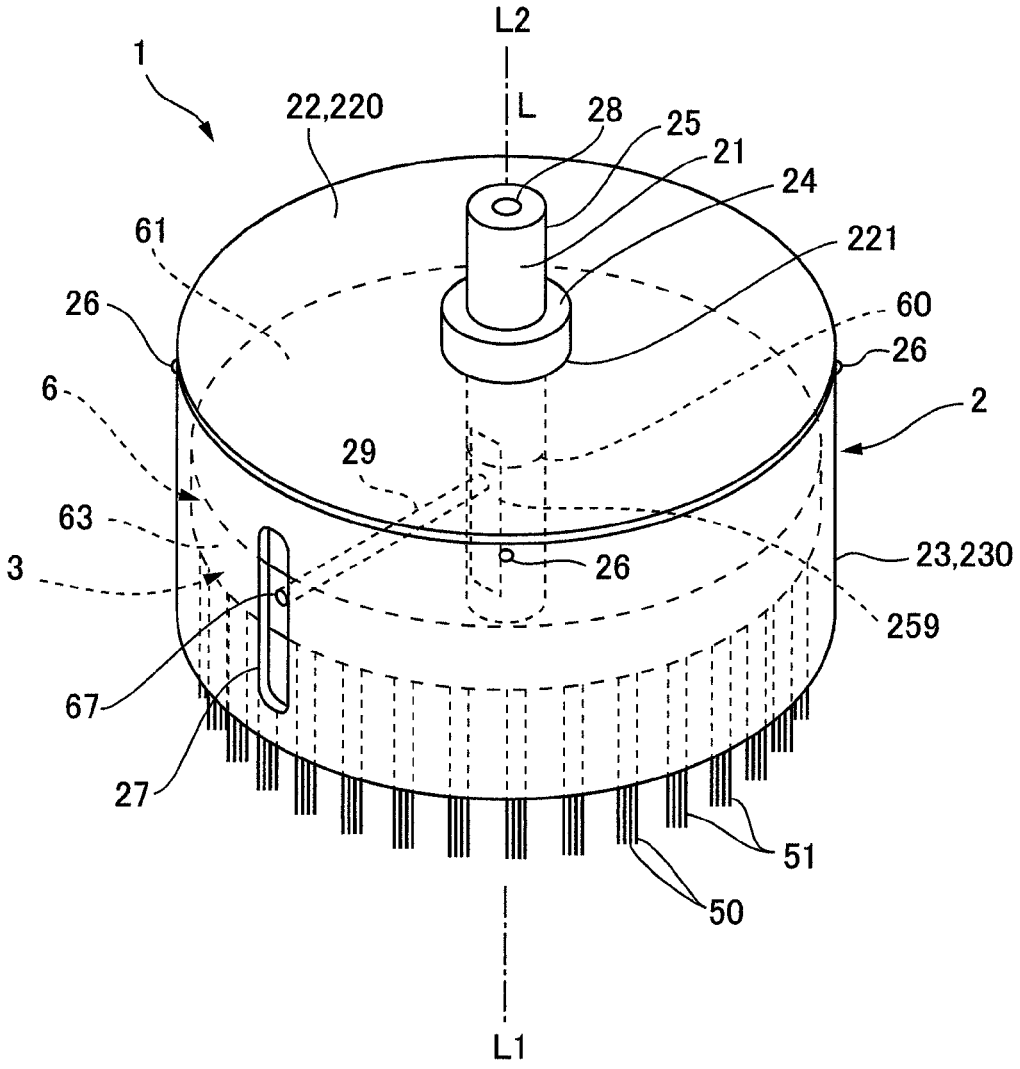
FIG. 1 is a schematic illustration of a polishing brush according to an embodiment 1 of the present invention in a state that a brush-like grinding stone is fixed to a brush case.
Figure 2:
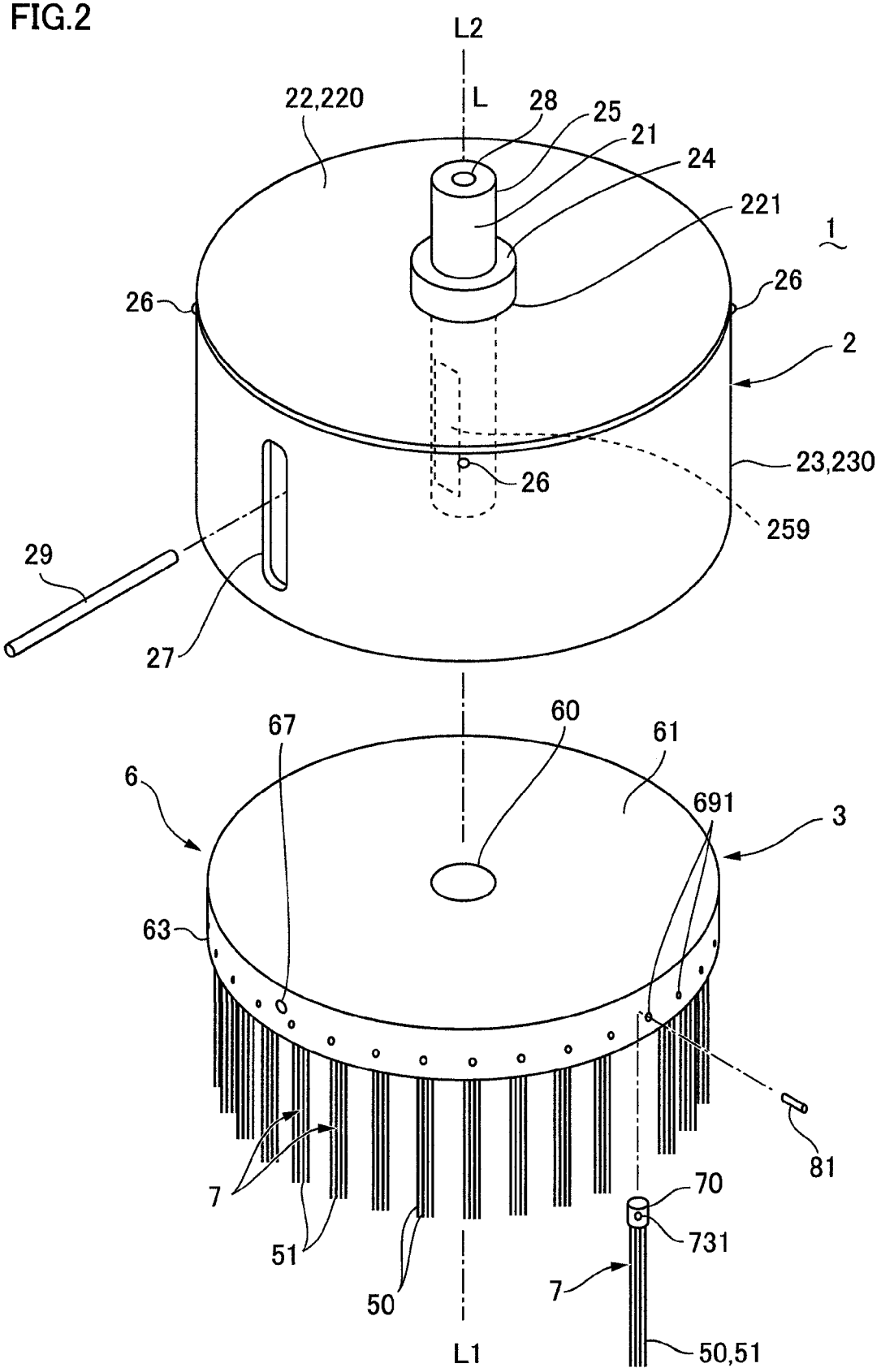
FIG. 2 is an exploded perspective view schematically illustrating the polishing brush illustrated in FIG. 1 disassembled into the brush case and the brush-like grinding stone.

FIG. 1 is a schematic illustration of a polishing brush according to an embodiment 1 of the present invention in a state that a brush-like grinding stone is fixed to a brush case. FIG. 2 is an exploded perspective view schematically illustrating the polishing brush illustrated in FIG. 1 disassembled into the brush case and the brush-like grinding stone.

As illustrated in FIG. 1 and FIG. 2, a polishing brush 1 of the present embodiment includes a brush-like grinding stone 3 including a plurality of linear members 50 obtained by hardening aggregated yarn of inorganic filaments, such as aluminum filaments, by a resin binder, and a brush case 2 that holds the brush-like grinding stone 3, and is used for polishing a workpiece (polished material) with the free ends (tips) of the linear members 50. In the brush-like grinding stone 3, a plurality of bundles 51 made of the linear members 50 are held on a brush holder 6.

The linear members 50 each are an aggregate of inorganic filaments, such as aluminum filaments, that is impregnated with a resin binder, such as an epoxy resin and a silicone resin, and is thereafter cured and shaped in a line. The aggregated yarn is an aggregate of 250 to 3000 aluminum filaments (inorganic filaments) having a filament diameter of 8 to 50 μm. The aggregated yarn has a diameter of 0.1 mm to 2 mm. Hence, as with the aggregated yarn, each of the linear members 50 has a diameter of 0.1 mm to 2 mm. The inorganic filaments are not limited to a particular material as long as the material has a polishing property relative to the workpiece, that is, the material is harder and more fragile than the polishing target. For example, silicon carbide fibers, boron fibers, and grass fibers, in addition to aluminum fibers, can be used as the inorganic filaments. Note that these materials may be mixed depending on the polishing target. The aluminum fibers and the silicon carbide fibers have an excellent polishing property against a ferrous based metal and a non-ferrous based metal. In the present embodiment, as the inorganic filaments, aluminum filaments are used for the linear members 50.

Each of the linear members 50 has a cross-sectional shape of a circle, a regular polygon, or a flat shape. In this application, a circle means a perfect circle or a substantially perfect circle, a regular polygon means, for example, a square and a regular hexagon, and a flat shape means, for example, an ellipse, an oval, or a rectangle. In the present embodiment, the linear members 50 each having a circular cross-sectional shape are used. Note that, when the linear members 50 each having a cross-sectional shape of a flat shape are used, the flatness (size in thickness direction/size in width direction) is preferably 1.6 to 15, more preferably 1.6 to 10, and further preferably 2.0 to 4.0.

(Structure of Brush Case 2)

Figure 3A:
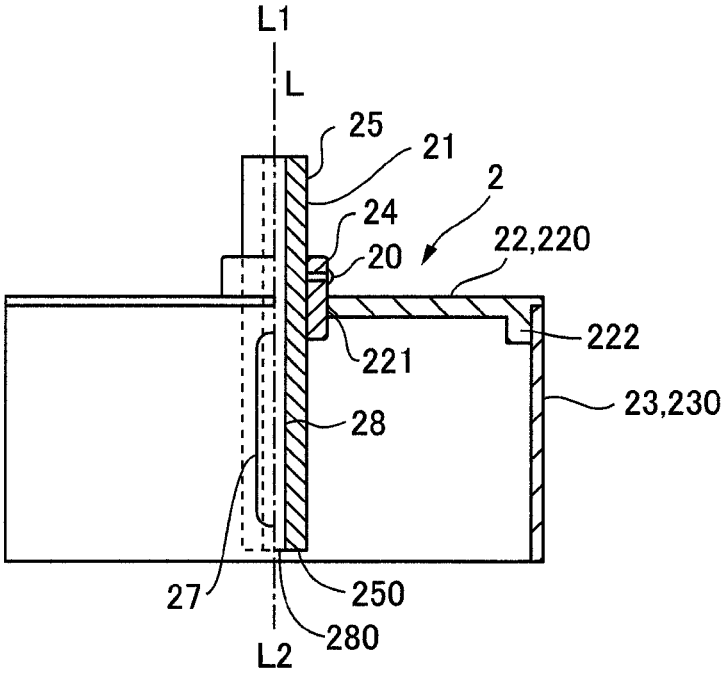
FIG. 3A is a side view illustrating the brush case partially cut-out (a right half) according to the embodiment 1 of the present invention.
Figure 3B:
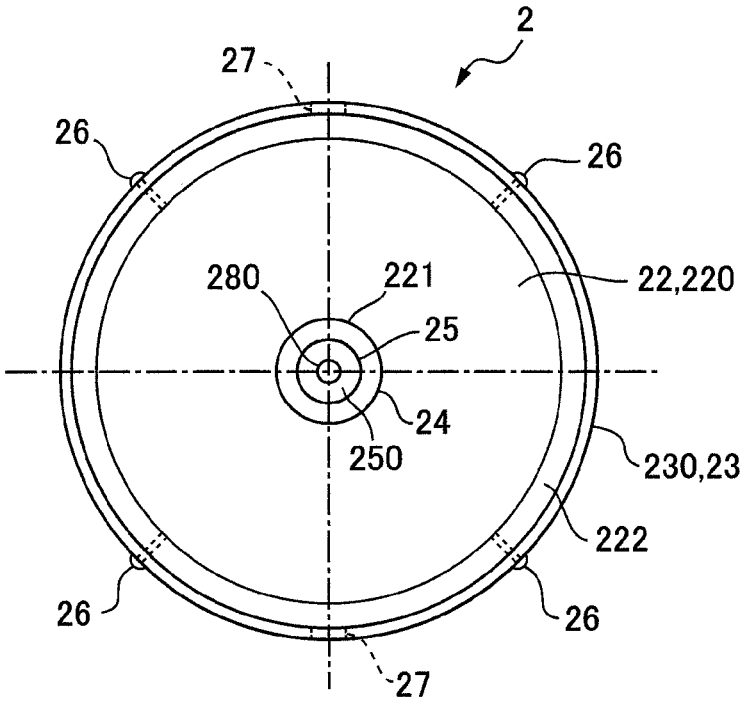
FIG. 3B is a bottom view of the brush case when viewed from the one side in the axial line direction according to the embodiment 1 of the present invention.

FIGS. 3A and 3B are illustrations of the brush case 2 of the polishing brush 1 according to the embodiment 1 of the present invention. FIG. 3A is a side view illustrating the brush case 2 partially cut-out (a right half). FIG. 3B is a bottom view of the brush case 2 when viewed from the one side in the axial line direction.

In FIG. 1, FIG. 2, FIG. 3A and FIG. 3B, the brush case 2 includes: an end plate 220 that is made of metal and constitutes a circular upper bottom 22; a cylinder 230 that is made of metal and constitutes a peripheral wall 23; a tube 24 that is fixed to a center hole 221 on the upper bottom 22; and a spindle 25 that is made of metal and is fixed to the tube 24 by means of screwing or other methods with the spindle 25 fitting to the tube 24. The cylinder 230 is fixed to a side plate 222 of the end plate 220 by screws 26. The spindle 25 projects from the upper bottom 22 toward the one side L1 in the axial line L direction. A part of the spindle 25 projecting from the upper bottom 22 forms a driving connecting shaft 21. The spindle 25 extends in the brush case 2 along the axial line L direction on the same axis as the peripheral wall 23.

The peripheral wall 23 of the brush case 2 is provides with a pair of groove-like guide holes 27 extending parallel to the axial line L direction on point symmetric positions with respect to the axial line L. In the present embodiment, the peripheral wall 23 and the spindle 25 of the brush case 2 are aluminum and stainless steel, respectively.

The brush case 2 is provided with a flow path 28 to discharge a liquid cutting agent toward the side (the one side L1) on which the free ends of the linear members 50 are located. In order to provide the flow path 28, a circular tube member is used as the spindle 25 in the present embodiment. The flow path 28 has an opening as a discharging port 280 at a bottom end surface 250 (end) of the spindle 25. Consequently, the discharging port 280 of the flow path 28 opens in a region surrounded by the linear members 50.

(Structure of Brush Holder 6)

Figure 4A:
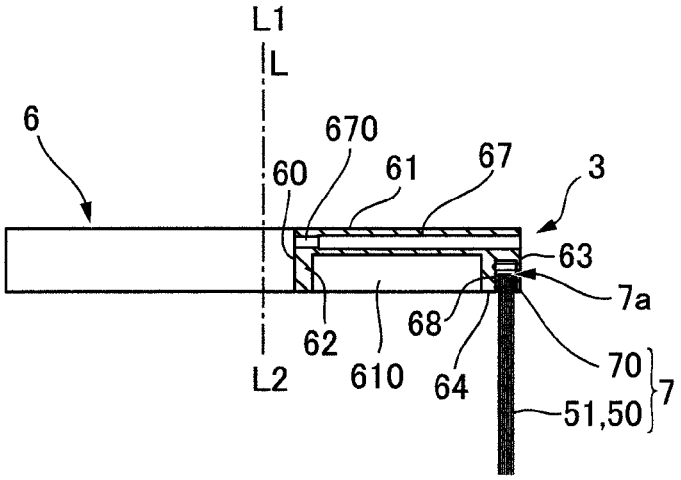
FIG. 4A is a side view illustrating the brush holder partially cut-out (a right half) according to the embodiment 1 of the present invention.
Figure 4B:
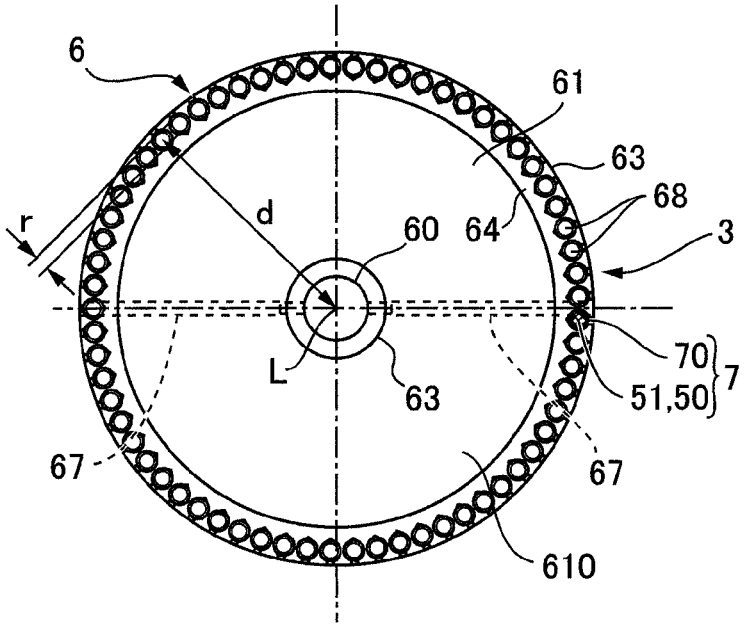
FIG. 4B is a bottom view of the brush holder when viewed from the one side in the axial line direction according to the embodiment 1 of the present invention.

FIGS. 4A and 4B are illustrations of the brush holder 6 of the polishing brush 1 according to the embodiment 1 of the present invention. FIG. 4A is a side view illustrating the brush holder 6 partially cut-out (a right half). FIG. 4B is a bottom view of the brush holder 6 when viewed from the one side in the axial line direction.

In FIG. 1, FIG. 2, FIG. 4A and FIG. 4B, the brush holder 6 has a substantially disk shape and holds thereon the bundles 51 of the linear members 50. The brush holder 6 has a surface on the one side L1 to which the linear member 50 extends in the axial line L direction. The surface has recesses 681 on a part substantially between a position displaced radially outward from the axial line L and an outer edge in the radial direction. The brush holder 6 is provided with a tube 62 in the center of a bottom plate 61, the tube 62 having a spindle hole 30 through which the spindle 25 passes. In the brush holder 6, a radially outer edge of the bottom plate 61 is provided with a cylinder 63 protruding toward the one side L1 in the axial line L direction.

In the present embodiment, the bundle 51 of the linear member 50 extends from a front end surface 64 directed to the one side L1 in the axial line L direction of the cylinder 63 toward the one side L1 in the axial line L direction. The front end surface 64 of the cylinder 63 is provided with a plurality of holding holes 68 at equal angular intervals in the circumferential direction, and the holding holes 68 each holds the bundle 51 of the linear member 50. In the present embodiment, the front end surface 64 of the cylinder 63 is provided with the holding holes 68 in a single turn, and thus the bundles 51 of the linear members 50 are held in one turn. The brush holder 6 is radially enlarged and holds a large number of the bundles 51. For example, the brush holder 6 has an outer diameter of about 200 mm and holds 64 bundles 51.

As described later with reference to FIGS. 5A, 5B and 5C, the bundle 51 of the linear member 50 one end of which is fixed to a linear member holder 70 with adhesive forms the linear member aggregate 7. The linear member aggregate 7 is held in the holding hole 68 of the brush holder 6.

In the brush-like grinding stone 3 thus structured, the bundles 51 are held on the front end surface 64 of the cylinder 63 at equal angular intervals around the spindle hole 30. Consequently, in a state that the spindle 25 is inserted in the spindle hole 60, the bundles 51 of the linear members 50 are extending along the axial line L around the spindle 25.

The bottom plate 61 of the brush holder 6 is provided with holes 67 at point symmetrical positions with the axial line L interposed therebetween, the holes 67 reaching the spindle hole 60 from the outer circumferential surface of the bottom plate 61. In the inner circumferential surfaces of the holes 67, parts closer to the spindle hole 60 are provided with female threads 670 (screw holes) are provided.

(Assembling Method of Polishing Brush 1)

In order to assemble the polishing brush 1 of the present embodiment, the brush-like grinding stone 3 is inserted in the brush case 2 so that the spindle 25 fits in the spindle hole 60 of the brush holder 6. Thereafter, screws 29 are inserted in the pair of guide holes 27 from the outer circumference of the brush case 2, and the screws 29 are fixed to the female threads 670 in the holes 67 of the brush holder 6. In this process, the screws 29 are tightened until the tips of the screws 29 abut on the outer circumferential surface of the spindle 25. As a result, in the brush case 2, the brush holder 6 is fixed to the spindle 25 of the brush case 2 through the screws 29. In the embodiment, the spindle 25 has flat surfaces 259 to which the tips of the screws 29 abut. It is preferable that three or more fixing parts each including the screws 29, the guide holes 27, and the holes 67 (the female threads 670) be provided in the circumferential direction, for example, three at equal angular intervals. With this configuration, even if the polishing brush 1 is radially enlarged, the brush-like grinding stone 3 is stably attached to the brush case 2.

The screws 29 are screwed shallowly in the female threads 670 of the brush holder 6 through the guide holes 27 of the brush case 2, and in this state, by moving the brush-like grinding stone 3 in the brush case 2 in the axial line L direction, the position of the brush-like grinding stone 3 in the axial line L direction in the brush case 2 can be adjusted. Consequently, the projection length of the free ends of the linear members 50 at the bottom end of the brush case 2 can be adjusted. Thus, the stiffness, in other words, the grinding property and flexibility of the linear members 50 can be optimized. In the present embodiment, although the guide holes 27 extend parallel to the axial line L, the guide holes 27 may extend oblique to the axial line L.

(Polishing Method Using Polishing Brush 1)

The polishing brush 1 of the present embodiment is connected to a polishing machine through the driving connecting shaft 21 projecting from the top of the brush case 2. In addition, in the polishing machine, the polishing brush 1 is rotary driven about the axial line L in a state that the tips of the free ends of the linear members 50 contact a workpiece and, for example, used for polishing and deburring various workpieces. In addition, if the linear members 50 in polishing tend to escape toward the outer circumference, the linear members 50 abut on the inner surface of the peripheral wall 23 of the brush case 2, and thus the escape toward the outer circumference is suppressed. The polishing brush 1 in polishing may be set to perform motion including not only rotation but also reciprocation, oscillation, swing, and combination thereof. In addition, vertical motion of the polishing brush 1 in the axial line L direction may be combined.

When the above mentioned polishing and deburring are performed, in the present embodiment, the liquid cutting agent is supplied to the flow path 28 formed in the spindle 25 of the polishing brush 1 through the driving connecting shaft 21 and is discharged from the discharging port 280. As a result, cutting dust generated between the tips of the linear members 50 and the workpiece is flown out with the cutting agent. The cutting agent may be an oil-based cutting agent (machining oil) or a water-soluble cutting agent.

Through the above mentioned polishing and deburring, the linear members 50 themselves are worn down and the projection length of the linear members 50 at the bottom end of the brush case 2 is shortened. In such a state, excellent deburring or polishing cannot be performed. Thus, the stiffness, in other words, the grinding property and flexibility of the linear members 50 are adjusted by adjusting the projection length of the linear members 50 at the bottom end of the brush case 2. In order to perform such adjustment, the screws 29 are loosened, and, by moving the brush-like grinding stone 3 in the brush case 2 in the axial line L direction, the position of the brush-like grinding stone 3 in the axial line L direction in the brush case 2 is displaced downward. Consequently, the projection length of the free ends of the linear members 50 at the bottom end of the brush case 2 can be adjusted to an optimal length again. In this process, the screws 29 are guided into the guide holes 27, whereby the brush-like grinding stone 3 is moved in the brush case 2 along the guide holes 27. In addition, in the present embodiment, the brush holder 6 is in a state of being fitted in the brush case 2 and the spindle 25 fits in the spindle hole 60 of the brush holder 6. Hence, the brash holder 6 is not inclined in the brush case 2 even if the dimensional tolerance between the outer diameter of the brush case 2 and the inner diameter of the brush case 2 is not strictly determined. Consequently, variance in the projection length of the linear members 50 at the bottom end of the brush case 2 does not occur. As a result, the grinding depth of the linear members 50 against the workpiece is constant, and thus the grinding accuracy improves. In addition, because the brush holder 6 can be fixed to the center of the brush case 2 even if the dimensional tolerance between the outer diameter of the brush holder 6 and the inner diameter of the brush case 2 is not strictly determined, eccentricity in rotation does not occur.

(Structure of Linear Member Aggregate 7)

Figure 5A:
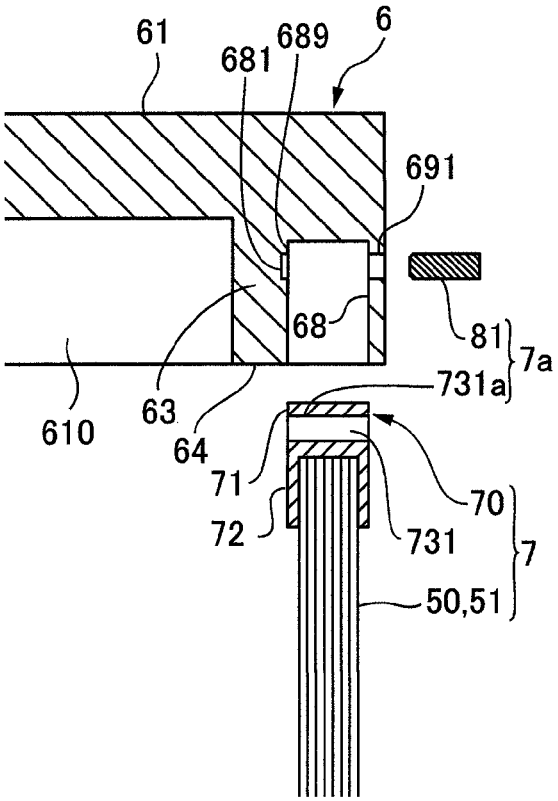
FIG. 5A is an illustration of a state before the linear member aggregate is attached to the brush holder according to the embodiment 1 of the present invention.
Figure 5B:
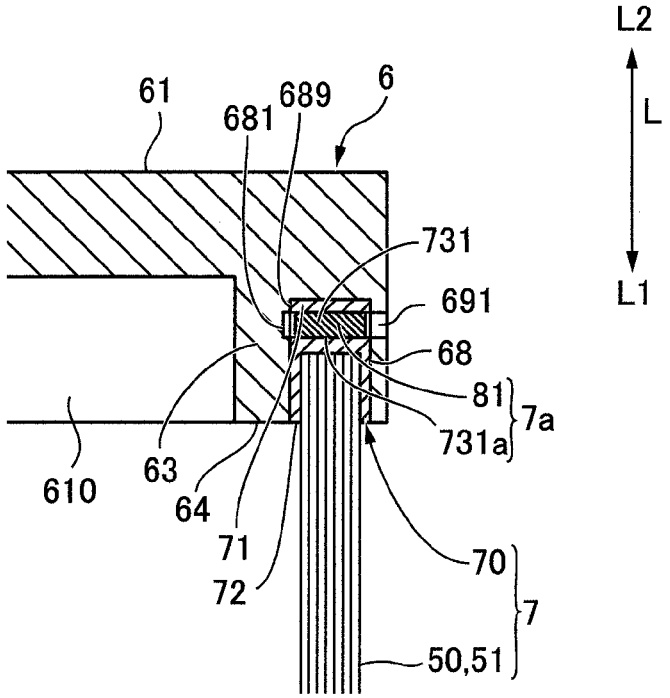
FIG. 5B is an illustration of a state after the linear member holder of the linear member aggregate is inserted in the holding hole 68 of the brush holder according to the embodiment 1 of the present invention.
Figure 5C:
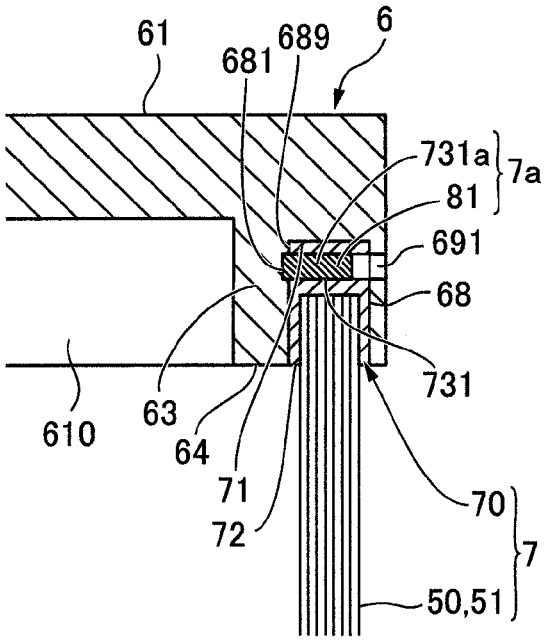
FIG. 5C is an illustration of the state after the linear member holder of the linear member aggregate is fixed to the holding hole with a screw according to the embodiment 1 of the present invention.

FIGS. 5A, 5B and 5C are illustrations of the linear member aggregate 7 applied to the polishing brush 1 according to the embodiment 1 of the present invention. FIG. 5A is an illustration of a state before the linear member aggregate 7 is attached to the brush holder 6, FIG. 5B is an illustration of a state after the linear member holder 70 of the linear member aggregate 7 is inserted in the holding hole 68 of the brush holder 6, and FIG. 5C is an illustration of the state after the linear member holder 70 of the linear member aggregate 7 is fixed to the holding hole 68 with a screw 81.

As illustrated in FIG. 4A, FIG. 4B, FIG. 5A, FIG. 5B and FIG. 5C, the bundle 51 of the linear member 50 one end of which is fixed to the linear member holder 70 with adhesive forms the linear member aggregate 7. The linear member aggregate 7 is held in the holding hole 68 of the brush holder 6 in this state.

In the linear member aggregate 7, the linear member holder 70 has a bottom 71 at a position in the other side L2 in the axial line L direction, and a tube 72 cylindrically extending toward the one side L1 in the axial line L direction from an outer edge of the bottom 71. An end of the bundle 51 of the linear member 50 is fixed to the inside of the tube 72 with adhesive. In the present embodiment, the holding hole 68 is a circular hole. The tube 72 of the linear member holder 70 has an outer diameter slightly smaller than an inner diameter of the holding hole 68.

In the present embodiment, to attach the linear member aggregate 7 to the brush holder 6, the linear member aggregate 7 is detachably attached to the holding hole 68 of the brush holder 6 by a threaded fixing mechanism 7*a* using a set screw 81. More specifically, the bottom 71 of the linear member holder 70 is provided with a first fixing hole 731 passing through in a direction orthogonal to the axial line L direction, and an inner circumferential surface of the first fixing hole 731 is provided with a female thread 731*a*. The cylinder 63 of the brush holder 6 is provided with a second fixing hole 691 passing through from the outer circumference to each of the holding holes 68. In each of the holding holes 68, the recess 681 is provided to a position facing the second fixing hole 691 in an inner wall 689 (in the radial inward direction) opposite to a side in which the second fixing hole 691 is located.

In the present embodiment, to attach the linear member aggregate 7 to the brush holder 6, first, the linear member aggregate 7 illustrated in FIG. 5A is prepared, then, as illustrated in FIG. 5B, the set screw 81 is set in the first fixing hole 731. In the present embodiment, the length of the set screw 81 is shorter than the length of the first fixing hole 731, and thus the set screw 81 does not protrude from the first fixing hole 731.

Next, the linear member holder 70 of the linear member aggregate 7 is inserted in the holding hole 68 of the brush holder 6. In this process, the orientation of the linear member holder 70 is adjusted, so that the first fixing hole 731 communicates with the second fixing hole 691 and the recess 681. Next, the set screw 81 is fastened with a screw driver the shaft of which is inserted from the second fixing hole 691. Thereafter, as illustrated in FIG. 5C, the tip of the set screw 81 abuts on the inner wall 689 of the holding hole 68 opposite to the side in which the second fixing hole 691 is positioned (radially inside). As a result, the linear member holder 70 is detachably attached to the holding hole 68 of the brush holder 6 with the threaded fixing mechanism 7*a* including the female thread 731*a* and the set screw 81. The tip of the set screw 81 having entered in the recess 681, so that falling off of the linear member aggregate 7 is securely prevented.

(Structure Around Attaching Position of Linear Member Aggregate 7)

As illustrated in FIG. 4B, in the brush-like grinding stone 3 used for the polishing brush 1 of the present invention, a distance d and a radius r satisfy the following conditional expression:

$$r<0.111d$$

when d is a radial direction from the center axis (the axial line L) of the brush holder 6 to a position of the linear member holder 70 attached to the brush holder 6 (the center of the linear member holder 70), and r is the radius of the bundle 51. With this configuration, when the brush-like grinding stone 3 (the brush holder 6) is rotated about the center axis to perform polishing, the difference between the peripheral speed of the linear member 50 in the bundles 51 close to the radial center of the brush holder 6 and the peripheral speed of the linear member 51 in the bundles 50 close to the radially outer circumference of the brush holder 6 can be less than 20%. As a result, proper polishing can be performed.

Note that the above-discussed conditional expression is defined for the following reason. First, in the bundle 51, a radial distance from the axial line L to the linear member 50 close to the radial center of the brush holder 6 is d−r, whereas a radial distance from the axial line L to the linear member 50 close to the radially outer circumference of the brush holder 6 is d+r. Here, the difference between the peripheral speed of the linear member 50 in the bundle 51 close to the radial center of the brush holder 6 and the peripheral speed of the linear member 50 in the bundle 51 close to the radially outer circumference of the brush holder 6 corresponds to the radial distance ratio. Consequently, by setting distance d and radius r so as to satisfy the following conditions, difference in peripheral speeds can be less than 20%.

$$0.8<(d-r)/(d+r)$$

$$0.8(d+r)<(d-r)$$

$$1.8r<0.2d$$

$$r<0.111d$$

In addition, by setting distance d and radius r so as to satisfy the following conditions, difference in peripheral speeds can be less than 10%.

$$0.9<(d-r)/(d+r)$$

$$0.9(d+r)<(d-r)$$

$$1.9r<0.1d$$

$$r<0.0526d$$

In this example, the holding hole 68 of the brush holder 6 is formed in a shape configured to fit with the linear member holder 70 of the linear member aggregate 7. Thus, in the brush holder 6, the position to which the linear member holder 70 is attached is the position of the center axis of the holding hole 68. Consequently, in the brush holder 6, distance d from the center axis (the axial line L) of the brush holder 6 to the position to which the linear member holder 70 is attached (the center of the linear member holder 70) is a distance from the center axis (the axial line L) of the brush holder 6 to the center axis of the holding hole 68.

(Replacing Method of Linear Member Aggregate 7)

In polishing with the brush-like grinding stone 3 and the polishing brush 1 of the present embodiment, in a case where any of the linear member aggregates 7 held on the brush holder 6 has a failure, such as abrasion or breakage of the linear member 50, the set screw 81 is loosened to remove the linear member aggregate 7 having a failure from the brush holder 6, thereafter, another linear member aggregated 7 is attached to the brush holder 6 to perform polishing. In addition, in a case where the linear member aggregates 7 held on the brush holder 6 are worn out, the set screws 81 are loosened to replace all the linear member aggregates 7, thereafter, polishing is performed.

(Changing Method of Number of Linear Member Aggregate 7)

In polishing with the brush-like grinding stone 3 and the polishing brush 1 of the present embodiment, in a case where the kind of a workpiece is changed and the number of the linear member aggregates 7 needs to be reduced, the set screw 81 is loosened to remove part of the linear member aggregates 7 from the brush holder 6, thereafter, polishing is performed. In a case where the kind of a workpiece is changed and the number of the linear member aggregates 7 needs to be increased, additional linear member aggregates 7 are attached to the brush holder 6 with the set screw 81 to perform polishing.

Main Effect of Present Embodiment

As described above, the bundle 51 of the linear member 50 one end of which is fixed to the linear member holder 70 with adhesive forms the linear member aggregate 7 that is used in the brush-like grinding stone 3 and the polishing brush 1 of the present embodiment. The linear member aggregate 7 is detachably fixed to the holding hole 68 of the brush holder 6 with the threaded fixing mechanism 7*a*. With this configuration, the linear member aggregates 7 held on the brush holder 6 can be easily reduced, increased, and replaced as needed. Thus, in a single brush-like grinding stone 3, the number of the bundles of the linear members can be changed in accordance with the kind of the workpiece to be polished or other conditions even though the brush holder 6 is radially enlarged and the bundles 51 of the linear members 50 are provided to an entire wide area on the brush holder 6 for effectively polishing an wide area on the workpiece. In addition, in a case where any of the bundles 51 of the linear members 50 has a failure, such as abrasion and breakage, only the failed bundle 51 needs to be replaced. Thus, it is not necessary to discard the entire brush-like grinding stone 3. Consequently, the polishing cost can be reduced.

The brush holder 6 has the bottom plate 61 and the cylinder 63 protruding from the outer circumference of the bottom plate 61 in the axial line L direction. The front end surface 64 of the cylinder 63 is provided with the holding holes 68. With this configuration, the brush holder 6 can be reduced in weight even if the brush holder 6 is radially enlarged. In addition, the cylinder 63 protrudes in the axial line L direction from the outer circumference of the bottom plate 61, serving as a weight. Thus, the brush holder 6 can rotate stably. Furthermore, because the holding holes 68 are provided to the front end surface of the cylinder 63, the holding holes 68 having a sufficient depth can be formed. As a result, the linear member aggregate 7 is detachable with respect to the holding hole 68 of the brush holder 6 with the threaded fixing mechanism 7*a*.

The length of the set screw 81 is shorter than the length of the first fixing hole 731, as illustrated in FIG. 5B, the linear member holder 70 can fit to the holing hole 68 while the set screw 81 is attached in the first fixing hole 731 in advance. As a result, the linear member aggregate 7 can be attached to the brush holder 6 effectively.

REFORMED EXAMPLE 1 OF EMBODIMENT 1

Figure 6:
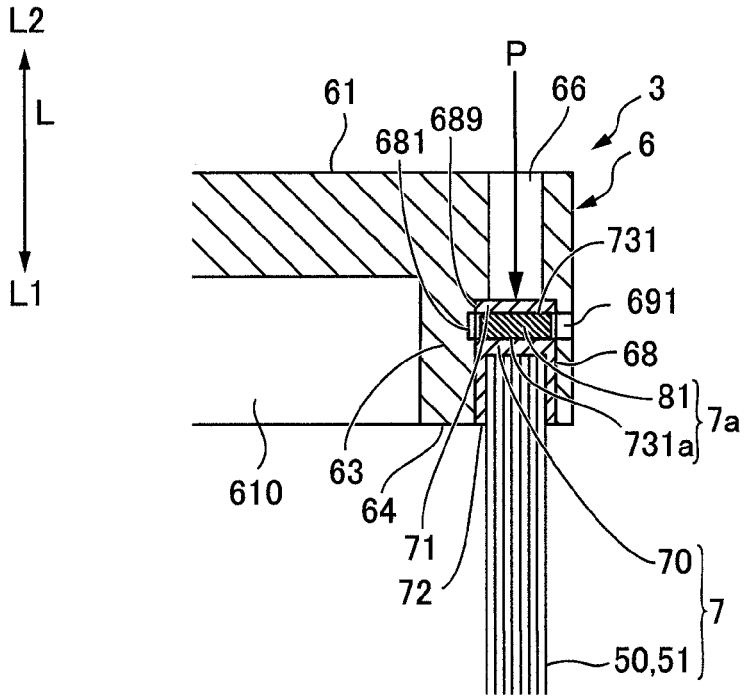
FIG. 6 is an illustration of a linear member aggregate applied to a polishing brush according to a reformed example 1 of the embodiment 1 of the present invention.

FIG. 6 is an illustration of the linear member aggregate 7 applied to the polishing brush 1 according to a reformed example 1 of the embodiment 1 of the present invention. The present embodiment and the later described embodiments have a basic structure as the same as that of the embodiment 1. Hence, common reference signs are given to common components and descriptions thereof are omitted.

As illustrated in FIG. 6, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. The linear member aggregate 7 is detachably attached to the holding hole 68 of the brush holder 6 with the threaded fixing mechanism 7*a* using the set screw 81.

The brush holder 6 is provided with a through hole 66 in communication with the holding hole 68 at a position overlapping the linear member holder 70 on the other side L2 in the axial line L direction. With this configuration, as shown by arrow P, the linear member holder 70 can be pushed out from the holding hole 68 with a jig (not illustrated) inserted in the through hole 66, when the linear member aggregate 7 is removed. Thus, in a case where the outer diameter of the tube 72 of the linear member holder 70 is slightly smaller than the inner diameter of the holding hole 68, the linear member holder 70 can be easily removed from the holding hole 68. Note that the jig may be configured to be inserted in one through hole 66, or may be configured to be inserted in a plurality of through holes 66 at the same time. Note that the other structures of the present embodiment are the same as that of the embodiment 1. Hence, descriptions thereof are omitted.

REFORMED EXAMPLE 2 OF EMBODIMENT 1

Figure 7A:
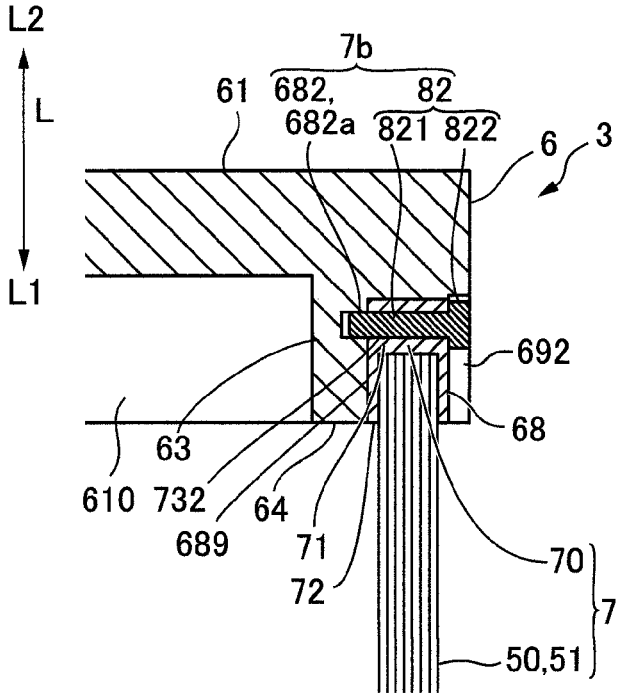
FIG. 7A is a sectional view of the threaded fixing mechanism according to an embodiment 2 of the present invention.
Figure 7B:
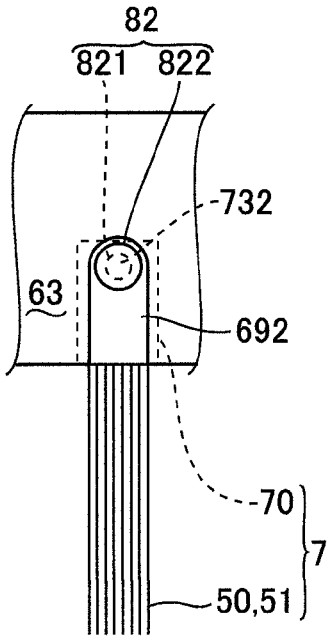
FIG. 7B is a side view of the threaded fixing mechanism viewed from the outside in the radial direction according to an embodiment 2 of the present invention.

In the embodiment 1 and the reformed example 1 of the embodiment 1, the second fixing hole 691 may extend in the axial line L direction similar to the second fixing hole 692 illustrated in FIG. 7B and reach the end of the cylinder 63. Specifically, in this example, the second fixing hole 692 is formed as a groove extending in the axial line L direction by cutting out the front end surface 64 of the cylinder 63 on the brush holder 6. With this configuration, in a state that an end of the set screw 81 (a shaft part) protrudes from the linear member holder 70 radially outward, the set screw 81 is guided along the second fixing hole 691 from the one side L1 to the other side L2 in the axial line L direction, whereby the linear member holder 70 is fit to the holding hole 68. For this reason, the linear member holder 70 can be inserted in the holding hole 68 in a state that the orientation of the linear member aggregate 7 is adjusted, and thus attaching the linear member aggregate 7 is easy. When the linear member aggregate 7 is removed, there is no need to fully unscrew the set screw 81 from the first fixing hole 732 of the linear member holder. That is, in a state that an end of the set screw 81 protrudes from the linear member holder 70 radially outward, the set screw 81 is guided along the second fixing hole 691 from the other side L2 to the one side L1 in the axial line L direction, whereby the linear member holder 70 is removed from the holding hole 68. Thus, removing the linear member aggregate 7 is easy.

Embodiment 2

FIGS. 7A, 7B and 7C are illustrations of a threaded fixing mechanism applied to the polishing brush 1 according to an embodiment 2 of the present invention. FIG. 7A is a sectional view of the threaded fixing mechanism and FIG. 7B is a side view of the threaded fixing mechanism viewed from the outside in the radial direction.

As illustrated in FIG. 7A, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, the linear member aggregate 7 is detachably attached to the holding hole 68 of the brush holder 6 with a threaded fixing mechanism 7*b* using a set screw 82.

More specifically, the bottom 71 of the linear member holder 70 is provided with a first fixing hole 732 passing through the linear member holder 70 in a direction orthogonal to the axial line L direction. The brush holder 6 is provided with a second fixing hole 692 passing through from the outer circumferential surface of the brush holder 6 to each of the holding holes 68, and a third fixing hole 682 open on an inner wall 689 of each of the holding holes 68 opposite to the second fixing hole 692 at a position in communication with the first fixing hole 732. On the inner circumferential surface of the third fixing hole 682 is provided with a female thread 682*a*. To the female thread 682*a*, the set screw 82 inserted in the first fixing hole 732 is set. In the present embodiment, a screw with a head is used as the set screw 82. A shaft 821 of the set screw 82 is positioned in the first fixing hole 732 and the third fixing hole 682. A head 822 of the set screw 82 abuts on the outer circumferential surface of the linear member holder 70. The second fixing hole 692 extends in the axial line L direction as illustrated in FIG. 7B and reaches the end of the cylinder 63.

As a result, the linear member holder 70 is detachably attached to the holding hole 68 of the brush holder 6 with the threaded fixing mechanism 7*b* including the female thread 682*a* and the set screw 82. The second fixing hole 692 is formed as a groove extending in the axial line L direction by cutting out the front end surface 64 of the cylinder 63 on the brush holder 6. Thus, in a state that the set screw 82 is partially fit to the linear member holder 70, the shaft 821 of the set screw 82 is guided along the second fixing hole 692 from the one side L1 to the other side L2 in the axial line L direction, whereby the linear member holder 70 is fit to the holding hole 68. Consequently, the linear member holder 70 to which the set screw 82 is preliminary fixed can be fit to the holding hole 68. In addition, the linear member holder 70 can be inserted in the holding hole 68 in a state that the orientation of the linear member aggregate 7 is adjusted. Thus, attaching the linear member aggregate 7 is easy. By loosening the set screw 82 in the linear member holder 70, the shaft 821 of the set screw 82 is guided along the second fixing hole 692 from the other side L2 to the one side L1 in the axial line L direction, whereby the linear member holder 70 is removed from the holding hole 68. For this reason, the linear member holder 70 can be removed from the holding hole 68 in a state that the set screw 82 is set to the linear member holder 70, and thus removing the linear member aggregate 7 is easy. Note that the other structures of the present embodiment are the same as that of the embodiment 1. Hence, descriptions thereof are omitted. In addition, in the present embodiment, the through hole 66 illustrated in FIG. 6 may be provided to the brush holder 6.

Embodiment 3

Figure 8:
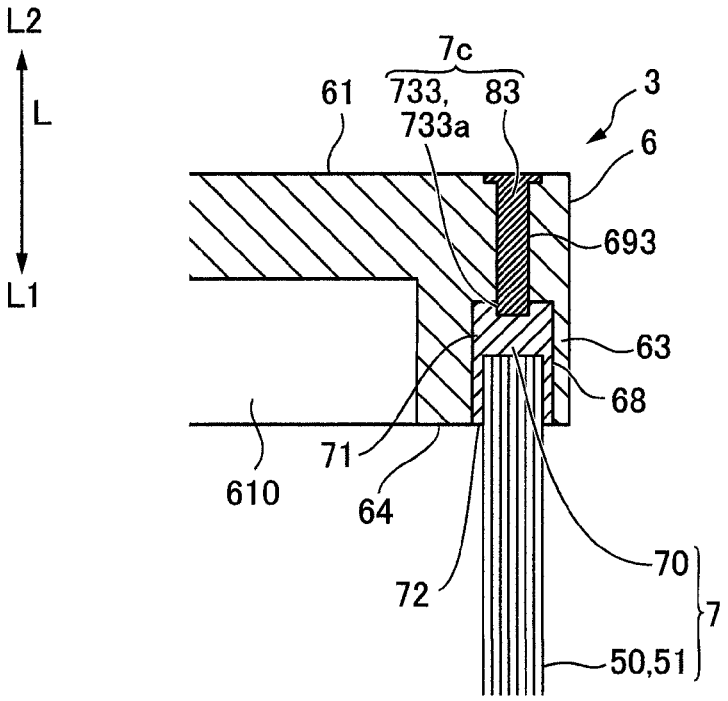
FIG. 8 is an illustration of a linear member aggregate applied to the polishing brush according to the embodiment 3 of the present invention.

FIG. 8 is an illustration of the linear member aggregate 7 applied to the polishing brush 1 according to an embodiment 3 of the present invention.

As illustrated in FIG. 8, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, the linear member aggregate 7 is detachably attached to the holding hole 68 of the brush holder 6 with a threaded fixing mechanism 7*c* using a set screw 83.

More specifically, the linear member holder 70 is provided with a first fixing hole 733 that is open in a surface on the other side L2 in the axial line L direction, and an inner circumferential surface of the first fixing hole 733 is provided with a female thread 733*a*. The brush holder 6 is provided with a second fixing hole 693 in communication with the holding holes 68 at a position overlapping the linear member holder 70 on the other side L2 in the axial line L direction. The set screw 83 with a head is attached through the second fixing hole 693 and fixed to the female thread 733*a* of the first fixing hole 733. As a result, the linear member holder 70 is detachably attached to the holding hole 68 of the brush holder 6 with the threaded fixing mechanism 7*c* including the female thread 733*a* and the set screw 83. Note that the other structures of the present embodiment are the same as that of the embodiment 1. Hence, descriptions thereof are omitted. In the present embodiment, the linear member aggregate 7 can be pushed out with a jig (not illustrated) inserted in the second fixing hole 693 instead of the through hole 66 illustrated in FIG. 6, when the linear member aggregate 7 is removed.

Embodiment 4

Figure 9:
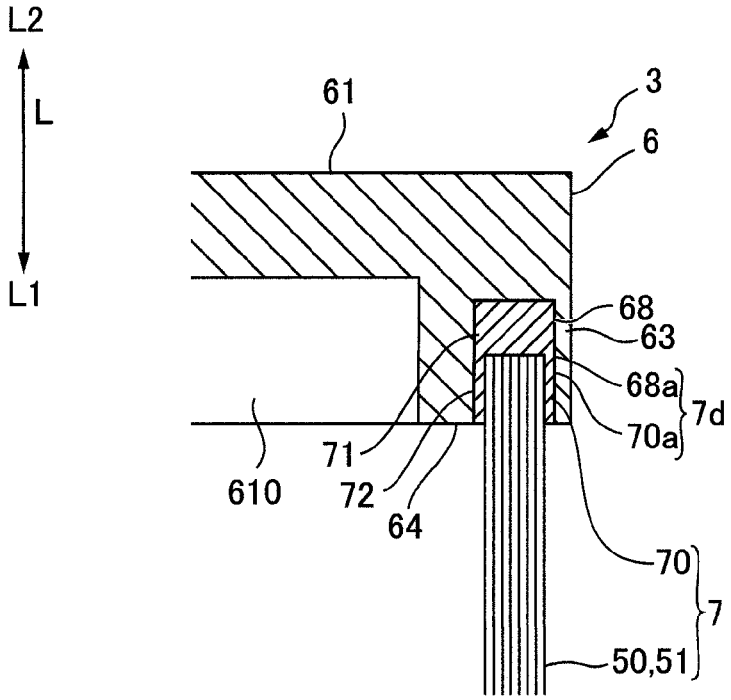
FIG. 9 is an illustration of a linear member aggregate applied to the polishing brush according to the embodiment 4 of the present invention.

FIG. 9 is an illustration of the linear member aggregate 7 applied to the polishing brush 1 according to an embodiment 4 of the present invention.

As illustrated in FIG. 9, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, the linear member aggregate 7 is detachably attached to the holding hole 68 of the brush holder 6 with the threaded fixing mechanism 7*d*.

More specifically, the inner circumferential surface of the holding hole 68 is provided with a female thread 68*a* and the outer circumferential surface of the linear member holder 70 is provided with a male thread 70*a* to be fixed to the female thread 68*a*. As a result, the linear member holder 70 is detachably attached to the holding hole 68 of the brush holder 6 with the threaded fixing mechanism 7*d* including the female thread 68*a* and the male thread 70*a*. Note that the other structures of the present embodiment are the same as that of the embodiment 1. Hence, descriptions thereof are omitted.

Embodiment 5

Figure 10:
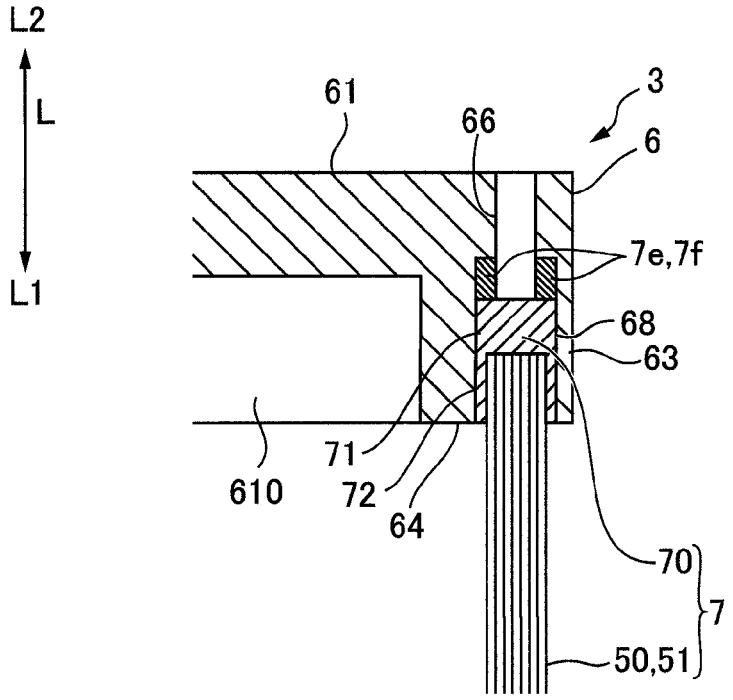
FIG. 10 is an illustration of a linear member aggregate applied to the polishing brush according to the embodiment 5 of the present invention.

FIG. 10 is an illustration of the linear member aggregate 7 applied to the polishing brush 1 according to an embodiment 5 of the present invention.

As illustrated in FIG. 10, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, the linear member aggregate 7 is detachably attached to the holding hole 68 of the brush holder 6 with a magnetic fixing mechanism 7*f* including a magnet 7*e*.

More specifically, the linear member holder 70 includes an iron-based metallic part, and therefore it can be magnetically attracted to the magnet 7*e*. In the present embodiment, the entire linear member holder 70 is an iron-based metallic part. The brush holder 6 holds therein the magnet 7*e* to magnetically attract the linear member holder 70. The magnet 7*e* is shaped in a ring, the brush holder 6 is provided with the through hole 66 at a position overlapping the linear member holder 70 on the other side L2 in the axial line L direction, the through hole 66 being in communication with the holding holes 68 and passing through the inside of the magnet 7*e*. As a result, the linear member holder 70 made of iron-based metallic is detachably attached to the holding hole 68 of the brush holder 6 with the magnetic fixing mechanism 7*f* including the linear member holder 70 and the magnet 7*e*. Note that the other structures of the present embodiment are the same as that of the embodiment 1. Hence, descriptions thereof are omitted. In addition, the magnet 7*e* may be provided to the linear member 70, however, providing the linear member aggregate 7 that is a consumable article with an iron-based metallic part can reduce the cost.

Embodiment 6

Figure 11:
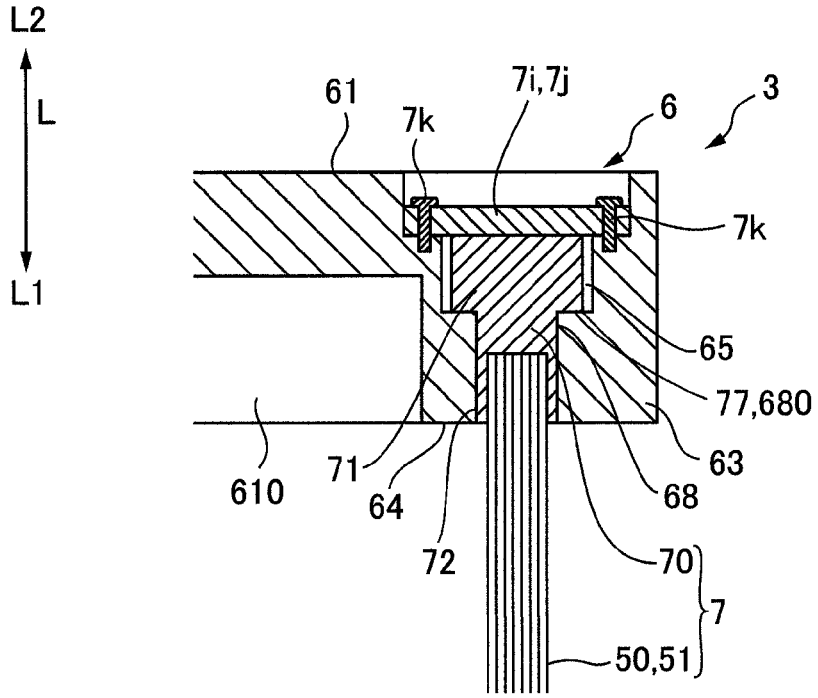
FIG. 11 is an illustration of a linear member aggregate applied to the polishing brush according to the embodiment 6 of the present invention.

FIG. 11 is an illustration of the linear member aggregate 7 applied to the polishing brush 1 according to an embodiment 6 of the present invention.

As illustrated in FIG. 11, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, the linear member aggregate 7 is detachably attached to the holding hole 68 of the brush holder 6 with a detachable fixing mechanism 7*j* using a fastener 7*i*.

More specifically, the brush holder 6 is provided with a stepped through hole 65 in communication with the holding holes 68 at a position overlapping the linear member holder 70 on the other side L2 in the axial line L direction. The outer circumferential surface of the linear member holder 70 has an outer circumferential surface including a part (a first stage 77/a supported part) in which an outer diameter of the other side L2 in the axial line L direction is larger than an outer diameter of the one side L1. The first stage 77 (the supported part) directs to the one side L1 in the axial line L direction. In the inner circumferential surface of the holding hole 68 is provided with a second stage 680 (a supporting part) configured to support the first stage 77 in a side on the one side L1. To the brush holder 6, the fastener 7*i* is detachably fixed with screws 7*k* or other means, the fastener 7*i* pressing the linear member holder 70 attached to the holding hole 68 from the other side L2 to the one side L1 through the through hole 65. The fastener 7*i* may have a structure to fix a single linear member holder 70, or may have a structure to fix the plurality of linear member holders 70. Note that the other structures of the present embodiment are the same as that of the embodiment 1. Hence, descriptions thereof are omitted.

Modification 1 of Embodiment 6

Figure 12:
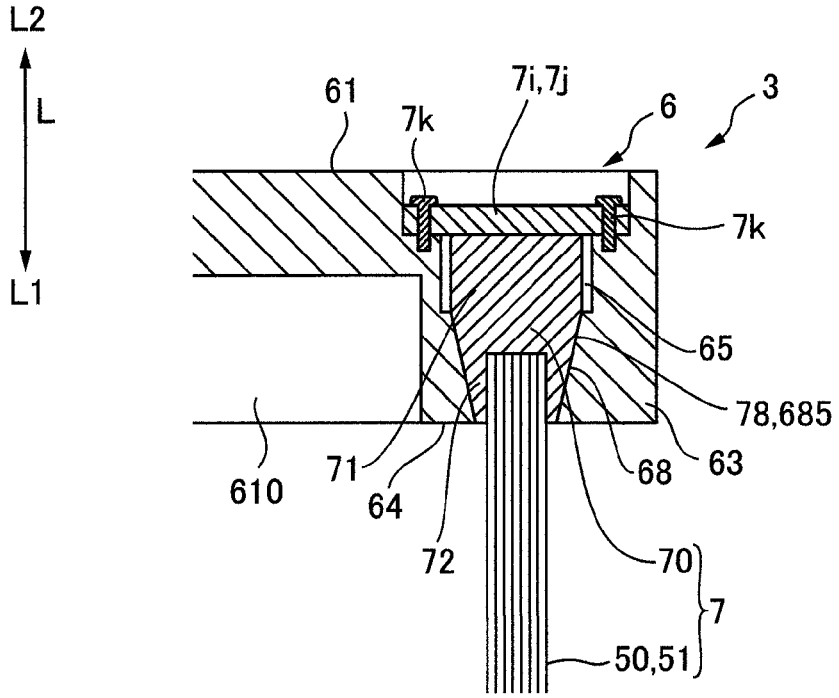
FIG. 12 is an illustration of a linear member aggregate applied to a polishing brush according to a modification 1 of the embodiment 6 of the present invention.

FIG. 12 is an illustration of the linear member aggregate 7 applied to a polishing brush 1 according to a modification 1 of the embodiment 6 of the present invention.

As illustrated in FIG. 12, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, similar to the embodiment 6, the linear member aggregate 7 is detachably attached to the holding hole 68 of the brush holder 6 with a detachable fixing mechanism 7*j* using the fastener 7*i*.

More specifically, the outer circumferential surface of the linear member holder 70 has an outer circumferential surface including a part (a first taper 78/a supported part) in which an outer diameter of the other side L2 in the axial line L direction is larger than an outer diameter of the one side L1. The first taper 78 (the supported part) directs to the one side L1 in the axial line L direction. In the inner circumferential surface of the holding hole 68 is provided with a second taper 685 (a supporting part) configured to support the first taper 78 in a side on the one side L1. To the brush holder 6, the fastener 7*i* is detachably fixed with the screws 7*k* or other means, the fastener 7*i* pressing the linear member holder 70 attached to the holding hole 68 from the other side L2 to the one side L1 through the through hole 65. Note that the other structures of the present embodiment are the same as that of the embodiments 1 and 6. Hence, descriptions thereof are omitted.

Modification 2 of Embodiment 6

Figure 13:
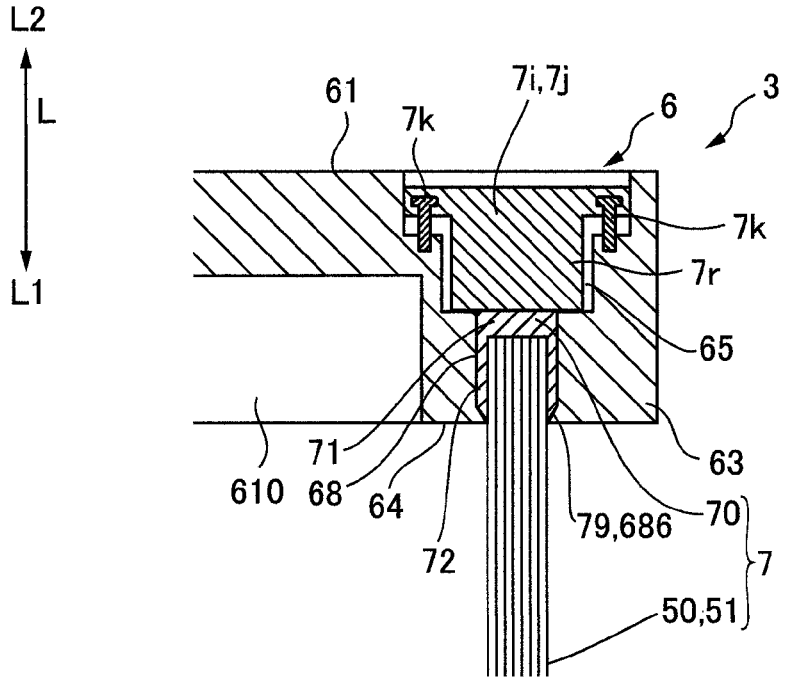
FIG. 13 is an illustration of a linear member aggregate applied to a polishing brush according to a modification 2 of the embodiment 6 of the present invention.

FIG. 13 is an illustration of the linear member aggregate 7 applied to a polishing brush 1 according to a modification 2 of the embodiment 6 of the present invention.

As illustrated in FIG. 13, similar to the embodiment 1, in the present embodiment, the bundle 51 of the linear member 50 one end of which is fixed to the linear member holder 70 forms the linear member aggregate 7. The linear member aggregate 7 is held in the holding hole 68 of the brush holder 6 in this state. In the present embodiment, similar to the embodiment 6, the linear member aggregate 7 is detachably attached to the holding hole 68 of the brush holder 6 with a detachable fixing mechanism 7*j* using the fastener 7*i*.

More specifically, the linear member holder 70 includes a part (an end face 79 of the tube 72 in the one side L1 in the axial line L direction/a supported part) directed to the one side L1 in the axial line L direction, and the inner circumferential surface of the holding hole 68 is provided with a projecting part 686 (a supporting part) protruding inward the holding hole 68 to support the end face 79 in a side of the one side L1. In the present embodiment, the end surface 79 is tapered, the outer diameter in a side on the other side L2 in the axial line L direction is larger than the outer diameter in a side on the one side L1. A surface of the projecting part 686 in the other side L2 in the axial line L direction is also tapered. To the brush holder 6, the fastener 7*i* is detachably fixed with the screws 7*k* or other means, the fastener 7*i* including a convex 7*r* for pressing the linear member holder 70 attached to the holding hole 68 from the other side L2 to the one side L1 through the through hole 65. With this configuration, after the linear member aggregate 7 is attached to the holding hole 68 from the other side L2 in the axial line L direction, by detachably fixing the fastener 7*i* to the brush holder 6, the linear member aggregate 7 is detachably attached to the holding hole 68. Note that the other structures of the present embodiment are the same as that of the embodiments 1 and 6. Hence, descriptions thereof are omitted.

Modification 3 of Embodiment 6

Figure 14:
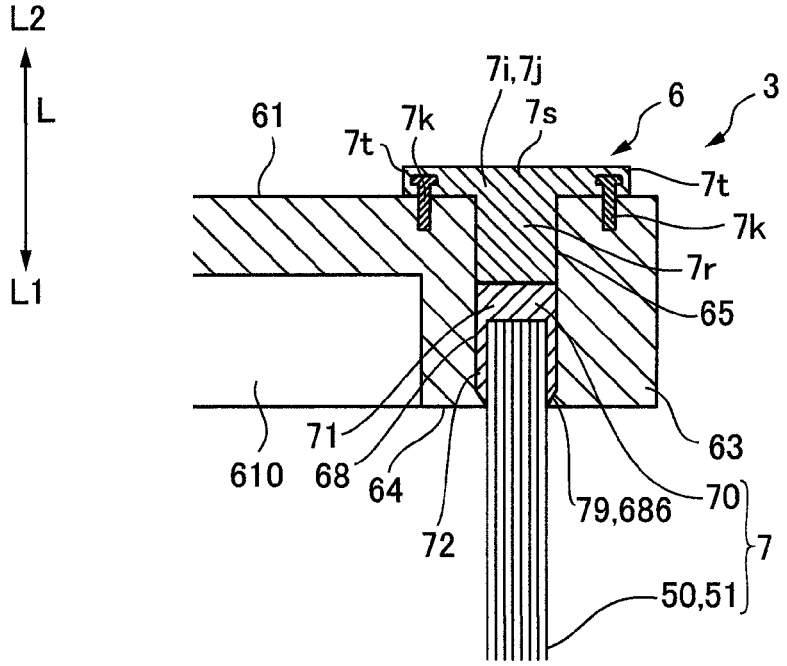
FIG. 14 is an illustration of a linear member aggregate applied to a polishing brush according to a modification 3 of the embodiment 6 of the present invention.

FIG. 14 is an illustration of a polishing brush 1 according to a modification 3 of the embodiment 6 of the present invention. The linear member aggregate 7 of the present embodiment is the same as the linear member aggregate 7 of the modification 2 of the embodiment 6. In the present embodiment, similar to the modification 2 of the embodiment 6, the linear member aggregate 7 is detachably attached to the holding hole 68 of the brush holder 6 with the detachable fixing mechanism 7*j* using the fastener 7*i*.

In the present example, the through hole 65 in communication with the holding hole 68 has no stages. The fastener 7*i* has the convex 7*r* inserted in the through hole 65 and a protrusion 7*s* protruded from the through hole 65 toward the other side L2. The fastener 7*i* is detachably fixed to the bottom 61 of the brush holder 6 from the other side L2 with the screws 7*k* penetrating a flange 7*t* provided to the protrusion 7*s*. The fastener 7*i* fixed to the bottom 61 presses the linear member holder 70 fit in the holding hole 68 from the other side L2 to the one side L1 through the through hole 65.

With this configuration, after the linear member aggregate 7 is fit in the holding hole 68 from the other side L2 in the axial line L direction, by detachably fixing the fastener 7*i* to the brush holder 6, the linear member aggregate 7 is detachably attached to the holding hole 68 of the brush holder 6. Note that the other structures of the present embodiment are the same as that of the modification 2 of the embodiment 6. Hence, descriptions thereof are omitted.

Embodiment 7

Figure 15:
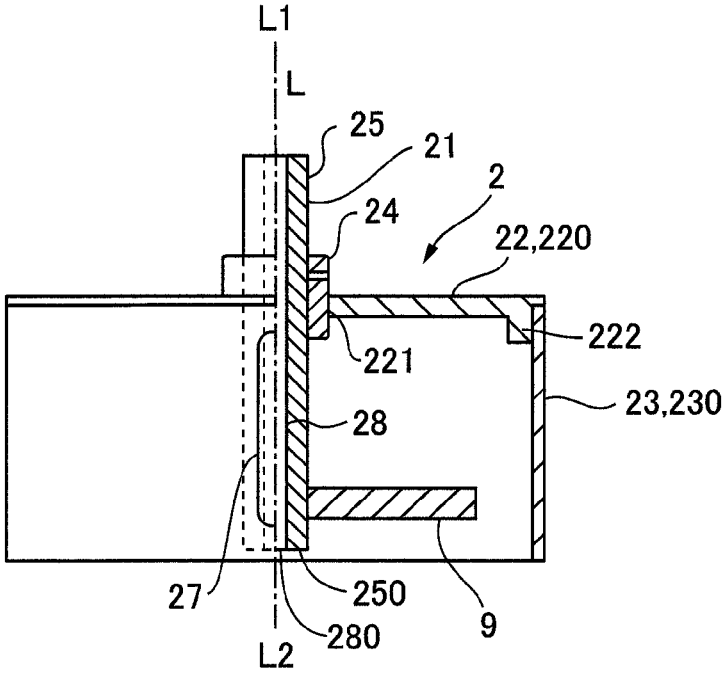
FIG. 15 is a partially cutout side view of a brush case of the polishing brush according to an embodiment 7 of the present invention.

FIG. 15 is an illustration of a brush case 2 of a polishing brush 1 according to an embodiment 7 of the present invention.

In FIG. 15, the spindle 25 of the brush case 2 is provided with a stopper 9 regulating a displacement of the linear member 50 to a radial inward direction. More specifically, the disk-like stopper 9 is disposed in the radially inside space of the linear members 50 illustrated in FIG. 1, FIG. 4A and FIG. 4B. Thus, when the polishing brush 1 rotates and moves along the surface of the workpiece, the displacement of the linear members 50 to the radial inward direction in the brush case 2 is regulated. Therefore, the contact pressure between the linear members 50 and the workpiece can be kept in a proper level.

(Modification of Linear Member Aggregate 7)

In the above-described examples, the linear member holder 70 included in the linear member aggregate 7 has an outer circumferential surface the section of which is a circle when viewed in the axial line direction of the bundle 51 of the linear member 50. By contrast, in the other linear member aggregates 7 excluding the linear member aggregate 7 of the embodiment 4 the outer circumferential surface of which is provided with the male thread 70*a*, the linear member holder 70 may have a non-circular holder part when viewed in the axial line L direction. In a case where the linear member aggregate 7 of the modification having a non-circular holder part is used, the brush holder 6 includes a fitting part in the holding hole 68 to fit to the holder part.

Figure 16A:
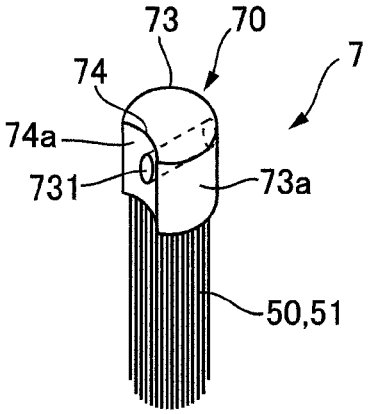
FIG. 16A is a perspective view of the linear member aggregate of the modification viewed from the other side according to the reformed example 1 of the embodiment 1 of the present invention.
Figure 16B:
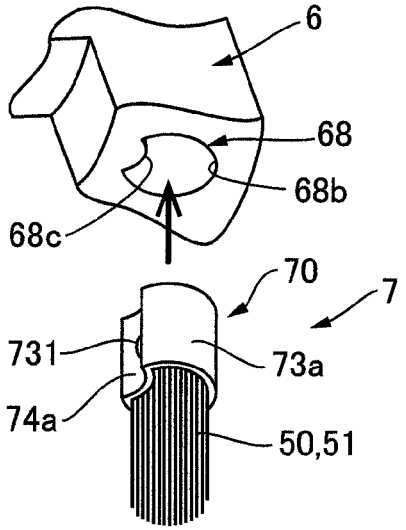
FIG. 16B is a diagram illustrating the operation of holding the linear member aggregate to the holding hole according to the reformed example 1 of the embodiment 1 of the present invention.
Figure 16C:
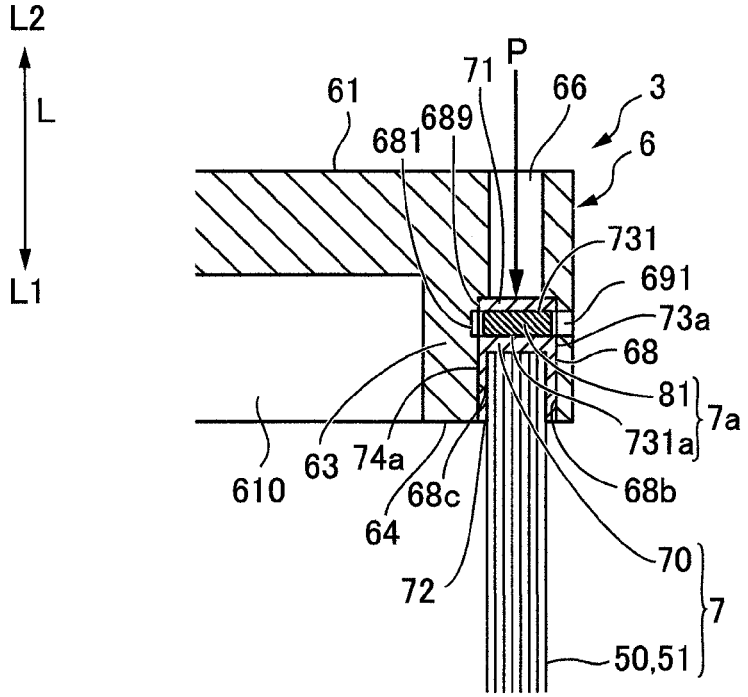
FIG. 16C is a sectional view around the holding hole according to the reformed example 1 of the embodiment 1 of the present invention.
Figure 17:
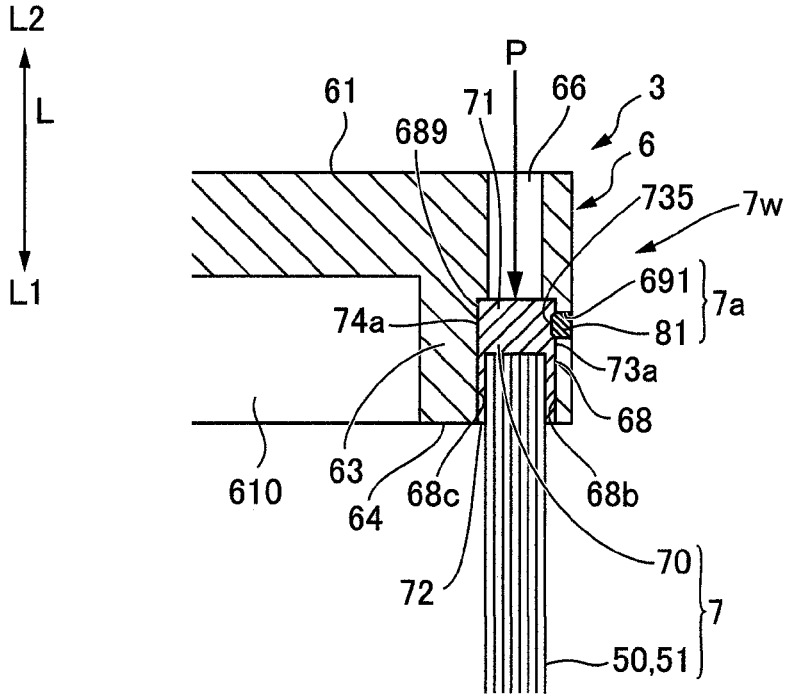
FIG. 17 is an illustration of a threaded fixing mechanism of a modification to which a linear member aggregate of a modification is applied.

FIGS. 16A, 16B and 16C are illustrations of a linear member aggregate 7 of a modification applied to the polishing brush 1 according to the reformed example 1 of the embodiment 1 illustrated in FIG. 6. FIG. 16A is a perspective view of the linear member aggregate 7 of the modification viewed from the other side L2. FIG. 16B is a diagram illustrating the operation of holding the linear member aggregate 7 to the holding hole 68. FIG. 16C is a sectional view around the holding hole 68. FIG. 17 is an illustration of the threaded fixing mechanism 7*a* when the linear member aggregate 7 of the modification applied to the polishing brush 1 according to the reformed example 1 of the embodiment 1 of the present invention.

As illustrated in FIG. 16A, with respect to the linear member aggregate 7 of the modification, the planar shape of the linear member holder 70 (the contours of the bottom 71 and the tube 72 when viewed in the axial line L direction) is not a circle when viewed in the axial line L direction. The planar shape of the linear member holder 70 is defined by a first arc 73 and a second arc 74. Consequently, the side surface of the linear member holder 70 has a first arc surface 73*a* and a second arc surface 74*a*, the first arc surface 73*a* being defined by the first arc 73, the second arc surface 74*a* being defined by the second arc 74.

The first arc 73 has a central angle of 240 degrees or larger. The second arc 74 connects one of the open ends of the first arc 73 to the other open end of the first arc 73. The radius of the second arc 74 is longer than the radius of the first arc 73 and the center of the second arc 74 matches the center line (the axial line L) of the brush holder 6 when the linear member holder 70 is held on the holding hole 68. The fixing hole 731 provided to the linear member holder 70 passes on the line connecting the centers of the first arc 73 and the second arc 74. In a case where the linear member holder 70 is not a circle when viewed in the axial line L direction, the radius r of the bundle 51 of the linear member 50 held on the linear member holder 70 is the same as the radius of the circumscribed circle that circumscribes on the bundle 51.

The entire holding hole 68 functions as a fitting part to fit to the linear member holder 70 as illustrated in FIGS. 16B and 16C. Consequently, the holding hole 68 includes a first arc inner circumference 68*b* defined by an arc corresponding to the first arc 73 and a second arc inner circumference 68*c* defined by an arc corresponding to the second arc 74. The center of the arc defining the second arc inner circumference 68*c* matches the center line (the axial line L) of the brush holder 6. Note that the other structures of the present embodiment are the same as that of the reformed example 1 of the embodiment 1. Hence, descriptions thereof are omitted.

With the present embodiment, fitting the linear member holder 70 to the holding hole 68 prevents the linear member holder 70 from rotating in the holding hole 68. Consequently, the behavior of the linear member aggregate 7 fixed to the brush holder 6 is prevented from being unstable in polishing. The insertion of the linear member holder 70 to the holding hole 68 defines the orientation of the linear member holder 70, therefore, the first fixing hole 731 easily communicates with the second fixing hole 691 and the recess 681, and the linear member aggregate 7 is easily fixed to the brush holder 6.

With the linear member aggregate 7 of the modification, fitting the linear member holder 70 to the holding hole 68 prevents the linear member aggregate 7 (the linear member holder 70) from rotating in the holding hole 68. As a result, there is no need to prevent the linear member holder 70 from rotating in the holding hole 68 with the set screw 81. Thus the linear member aggregate 7 can be fixed to the brush holder 6 with a threaded fixing mechanism 7*w* illustrated in FIG. 17. The threaded fixing mechanism 7*w* includes a set-screw positioning recess 735 and a female thread, the set-screw positioning recess 735 being formed in the center part in the circumferential direction of the first arc surface 73*a* in the linear member holder 70, the female thread being formed on the inner circumference of the second fixing hole 691 of the brush holder 6. Next, the set screw 81 is screwed in the second fixing hole 691 to position the tip of the set screw 81 protruding toward the linear member holder 70 from the second fixing hole 691 in the set-screw positioning recess 735. Thereafter, the set screw 81 is further screwed to be abutted on the linear member holder 70 to press the linear member holder 70 to the inner wall 689 of the holding hole 68, whereby the linear member aggregate 7 is fixed to the brush holder 6.

Note that the linear member holder 70 may be provided with a through hole having a smaller diameter than that of the set screw 81 and passing through in a direction orthogonal to the axial line L direction. The through hole may be used as the set-screw positioning recess. The set-screw positioning recess may be omitted. In a case where the linear member holder 70 included in the linear member aggregate 7 has an outer circumferential surface the section of which is a circle when viewed in the axial line direction of the bundle 51 of the linear member 50, the linear member aggregate 7 can be fixed to the brush holder 6 with the threaded fixing mechanism 7*w*. In this case, the set-screw positioning recess may be provided to the outer circumference of the linear member holder 70, the tip of the set screw 81 projected toward the linear member holder 70 from the second fixing hole 691 is positioned in the set-screw positioning recess 735, and the set screw 81 is further screwed, whereby the linear member aggregate 7 (the linear member holder 70) is prevented from rotating in the holding hole 68.

Figure 18A:
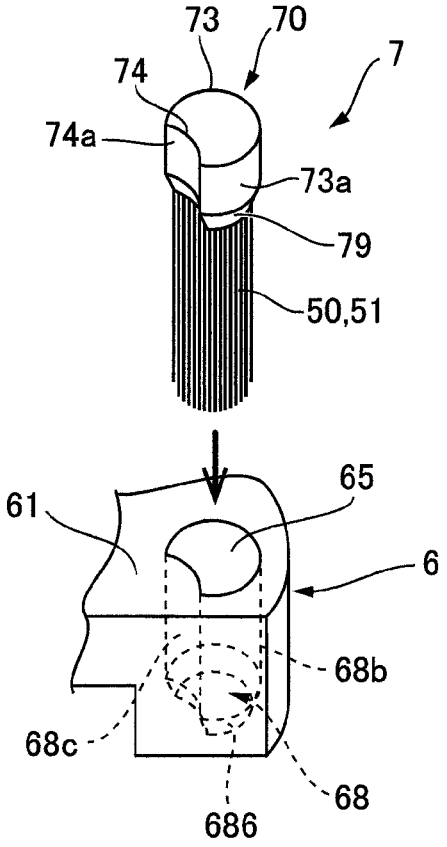
FIG. 18A is a perspective view of a linear member aggregate of a modification applied to the polishing brush according to the modification 3 of the embodiment 6 of the present invention.
Figure 18B:
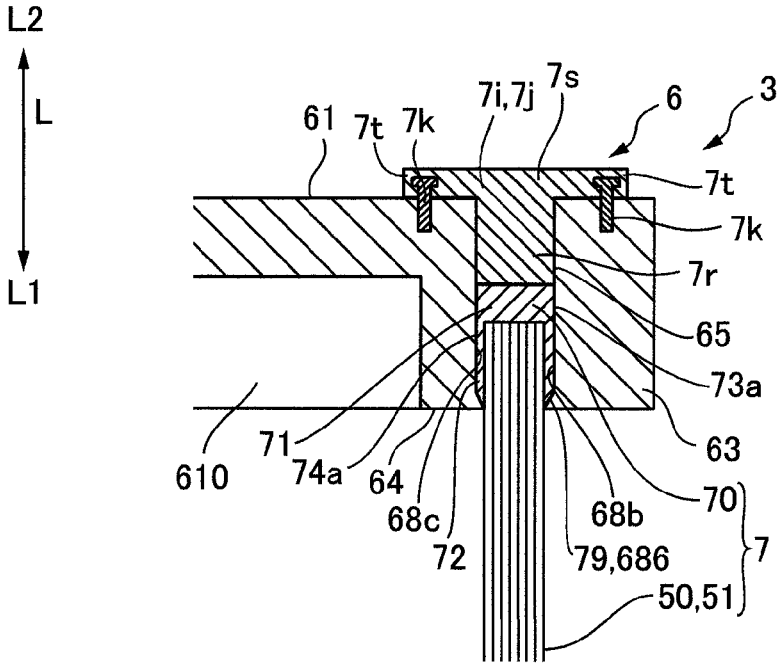
FIG. 18B is a sectional view around the holding hole according to the modification 3 of the embodiment 6 of the present invention.

FIGS. 18A and 18B are illustrations of a linear member aggregate 7 of the modification applied to the polishing brush 1 according to the modification 3 of the embodiment 6 of the present invention. In the linear member aggregate 7, the planar shape of the linear member holder 70 is defined by the first arc 73 and the second arc 74, similar to the linear member aggregate 7 illustrated in FIGS. 16A and 16B. Consequently, the side surface of the linear member holder 70 has the first arc surface 73*a* and the second arc surface 74*a*, the first arc surface 73*a* being defined by the first arc 73, the second arc surface 74*a* being defined by the second arc 74. The first arc 73 has a central angle of 240 degrees or larger. The second arc 74 connects one of the open ends of the first arc 73 to the other open end of the first arc 73. The radius of the second arc 74 is longer than the radius of the first arc 73 and the center of the second arc 74 matches the center line (the axial line L) of the brush holder 6 when the linear member holder 70 is held on the holding hole 68.

The entire holding hole 68 functions as a fitting part to fit to the linear member holder 70. Consequently, the inner circumference of the holding hole 68 includes the first arc inner circumference 68*b* defined by the arc corresponding to the first arc 73 and the second arc inner circumference 68*c* defined by the arc corresponding to the second arc 74. In the present example, the through hole 65 in communication with the holding hole 68 has the same shape as that of the holding hole 68 when viewed in the axial line L direction. The holding hole 68 and the through hole 65 are continued without steps. In the present example, the convex 7*r* of the fastener 7*i* has a shape allowed to be inserted into the through hole 65. Note that the other structures of the present embodiment are the same as that of the modification 3 of the embodiment 6. Hence, descriptions thereof are omitted.

As illustrated in FIG. 18B, in the present embodiment, similar to the embodiment 6, the linear member aggregate 7 is detachably attached to the holding hole 68 of the brush holder 6 with the detachable fixing mechanism 7*j* using the fastener 7*i*. With the present embodiment, fitting the linear member holder 70 to the holding hole 68 prevents the linear member holder 70 from rotating in the holding hole 68. Consequently, the behavior of the linear member aggregate 7 fixed to the brush holder 6 is prevented from being unstable in polishing.

The linear member aggregate 7 of the modification defines the planer shape of the linear member holder 70 viewed in the axial line L direction with the first arc 73 and the second arc 74. However, the planer shape of the linear member holder 70 can be defined by the first arc 73 and the chord (a straight line), instead of the second arc 74, connecting between the open ends of the first arc 73. The shape of the linear member holder 70 viewed in the axial line L direction may be a polygon. Furthermore, part of the linear member holder 70 in the axial line L direction may include a non-circular holder part. For example, the linear member holder 70 may include a non-circular holder part in an end opposite to the side to which the linear member 50 extends. In this case, a part of the holding hole 68 may be provided with a fitting part to fit to the holder part.

The invention claimed is:

1. A brush-like grinding stone comprising:

linear member aggregates, each of which includes a bundle of linear members and a linear member holder to which an end of the bundle is fixed; and a brush holder having a plurality of holding holes that are open in one side in an axial line direction, the linear member holders being detachably attached to the respective holding holes, wherein the brush holder is provided with a through hole in communication with one of the holding holes at a position overlapping one of the linear member holder on the other side opposite to the one side in the axial line direction when viewed in the axial line direction, wherein the linear member holders are detachably attached to the respective holding holes in the brush holder with a threaded fixing mechanism, one of the linear member holders is provided with a first fixing hole passing therethrough in a direction orthogonal to the axial line direction in a part opposite to a side to which the linear members extend, the brush holder is provided with a second fixing hole passing therethrough from an outer circumferential surface of the brush holder to one of the holding holes, and the threaded fixing mechanism includes a female thread and a set screw, the female thread being formed in an inner circumferential surface of the first fixing hole, and the set screw being configured so as to be in contact with an inner wall of one of the holding holes opposite to the second fixing hole by being set to the female thread in the first fixing hole.

2. The brush-like grinding stone according to claim 1, wherein the holding holes are formed on a radially outer edge of the brush holder.

3. The brush-like grinding stone according to claim 1, wherein the second fixing hole is a groove extending in the axial line direction formed by cutting out the one side of the brush holder in the axial line direction.

4. A brush-like grinding stone comprising:

linear member aggregates, each of which includes a bundle of linear members and a linear member holder to which an end of the bundle is fixed; and a brush holder having a plurality of holding holes that are open in one side in an axial line direction, the linear member holders being detachably attached to the respective holding holes, wherein the brush holder is provided with a through hole in communication with one of the holding holes at a position overlapping one of the linear member holder on the other side opposite to the one side in the axial line direction when viewed in the axial line direction, linear member holders are detachably attached to the respective holding holes in the brush holder with the threaded fixing mechanism, one of the linear member holders is provided with a first fixing hole passing therethrough in a direction orthogonal to the axial line direction in a part opposite to a side to which the linear members extend, the brush holder is provided with a second fixing hole passing therethrough from the outer circumferential surface of the brush holder to one of the holding holes, and a third fixing hole open on an inner wall of the one of the holding holes opposite to the second fixing hole at a position in communication with the first fixing hole, and the threaded fixing mechanism includes a female thread and a set screw, the female thread being formed in an inner circumferential surface of the third fixing hole, and the set screw being configured so as to be set in the female thread through the first fixing hole.

5. The brush-like grinding stone according to claim 4, wherein the second fixing hole is a groove extending in the axial line direction formed by cutting out the one side of the brush holder in the axial line direction.

* * * * *